US011705675B2

(12) United States Patent
Li et al.

(10) Patent No.: US 11,705,675 B2
(45) Date of Patent: Jul. 18, 2023

(54) CABLE CONNECTOR WITH IMPROVED SHIELDING PERFORMANCE

(71) Applicant: LUXSHARE PRECISION INDUSTRY CO., LTD., Shenzhen (CN)

(72) Inventors: Huabing Li, Shenzhen (CN); Zhongyuan Lai, Shenzhen (CN); Chenhui Zeng, Shenzhen (CN); Yu Huang, Shenzhen (CN)

(73) Assignee: LUXSHARE PRECISION INDUSTRY CO., LTD., Shenzhen (CN)

( * ) Notice: Subject to any disclaimer, the term of this patent is extended or adjusted under 35 U.S.C. 154(b) by 30 days.

(21) Appl. No.: 17/503,949

(22) Filed: Oct. 18, 2021

(65) Prior Publication Data

US 2022/0123509 A1 Apr. 21, 2022

(30) Foreign Application Priority Data

Oct. 19, 2020 (CN) ..... 202011120990.4
Nov. 24, 2020 (CN) ..... 202011332765.7

(51) Int. Cl.
*H01R 13/6592* (2011.01)
*H01R 13/405* (2006.01)
(Continued)

(52) U.S. Cl.
CPC ..... *H01R 13/6592* (2013.01); *H01R 13/405* (2013.01); *H01R 13/6581* (2013.01); *H01R 13/6597* (2013.01)

(58) Field of Classification Search
CPC ..... H01R 13/6592; H01R 13/405; H01R 13/6581; H01R 13/6597
(Continued)

(56) References Cited

U.S. PATENT DOCUMENTS

D517,016 S 3/2006 Nishio et al.
D521,937 S 5/2006 Nishio et al.
(Continued)

FOREIGN PATENT DOCUMENTS

CN 1988281 A 6/2007
CN 101136514 A 3/2008
(Continued)

OTHER PUBLICATIONS

U.S. Office Action for U.S. Appl. No. 29/776,430, dated Oct. 21, 2022.
(Continued)

*Primary Examiner* — Peter G Leigh
(74) *Attorney, Agent, or Firm* — Birch, Stewart, Kolasch & Birch, LLP

(57) ABSTRACT

A cable connector includes a number of cables and an electrical connector. Each cable includes a core wire, an insulating layer wrapped on the core wire and a shielding layer wrapped on the insulating layer. The electrical connector includes an insulating body, a number of conductive terminals and a shielding shell. Each conductive terminal includes a contact portion for mating with a mating connector and a tail portion connected with the core wire. The cable connector further includes a ground shield mounted to the cables. The ground shield is connected with the shielding layers of the cables, and the ground shield is connected with the shielding shell. Compared with the prior art, the present disclosure improves the shielding performance of the cable connector by providing connecting the ground shield, the shielding layers and the shielding shell together.

18 Claims, 28 Drawing Sheets

(51) Int. Cl.
*H01R 13/6581* (2011.01)
*H01R 13/6597* (2011.01)

(58) Field of Classification Search
USPC ..... 439/607.41
See application file for complete search history.

(56) References Cited

U.S. PATENT DOCUMENTS

| | | | | |
|---|---|---|---|---|
| D521,938 | S | 5/2006 | Nishio et al. | |
| D525,589 | S | 7/2006 | Wu | |
| 7,361,049 | B2 * | 4/2008 | Nagata | H01R 12/596 439/497 |
| D680,500 | S | 4/2013 | Xie et al. | |
| D688,651 | S | 8/2013 | Daniel | |
| D710,366 | S | 8/2014 | Kim | |
| D774,035 | S | 12/2016 | Kao | |
| 9,590,361 | B2 * | 3/2017 | Fan | H01R 13/65914 |
| 9,819,128 | B2 * | 11/2017 | Zhou | H01R 13/7172 |
| D835,109 | S | 12/2018 | Chen | |
| 10,498,090 | B2 * | 12/2019 | Wu | H01R 13/6593 |
| 10,547,147 | B2 | 1/2020 | Taniguchi et al. | |
| D959,428 | S | 8/2022 | Bockenstedt et al. | |
| D960,169 | S | 8/2022 | Liu | |
| 2004/0127098 | A1 | 7/2004 | Kuo et al. | |
| 2006/0035522 | A1 | 2/2006 | Kuroda et al. | |
| 2013/0109242 | A1 | 5/2013 | Li et al. | |
| 2013/0115822 | A1 | 5/2013 | Pan et al. | |
| 2017/0012395 | A1 * | 1/2017 | Fan | H01R 13/65914 |
| 2019/0252833 | A1 * | 8/2019 | Li | H01R 13/652 |
| 2019/0252834 | A1 * | 8/2019 | Wu | H01R 13/665 |
| 2021/0119374 | A1 | 4/2021 | Wan et al. | |
| 2022/0123510 | A1 | 4/2022 | Li et al. | |

FOREIGN PATENT DOCUMENTS

| | | | | | |
|---|---|---|---|---|---|
| CN | 101499568 | A | | 8/2009 | |
| CN | 101017933 | B | * | 9/2010 | H01R 12/596 |
| CN | 104218394 | A | * | 12/2014 | |
| CN | 104348014 | A | | 2/2015 | |
| CN | 204230556 | U | * | 3/2015 | |
| CN | 107181090 | A | | 9/2017 | |
| CN | 208299151 | U | | 12/2018 | |
| CN | 109301600 | A | | 2/2019 | |
| CN | 110137726 | A | | 8/2019 | |
| CN | 110867682 | A | | 3/2020 | |
| TW | M492554 | U | | 12/2014 | |
| TW | 202021210 | A | | 6/2020 | |

OTHER PUBLICATIONS

"5 Pcs HDMI Male 19 Pins A Type Solder Plug Termination Re Replace," Shopee, May 5, 2021, retrieved from https://shopee.com.my/5-Pcs-HDMI-Male-19-Pins-A-Type-Solder-Plug-Termination-Repair-Replace-i, 4 pages total.

"60S019P-301N-B1," Newark. Nov. 18, 2020, retrieved from https://www.newark.com/multicomp/60s019p-301n-bi/connector-hdmi-plug-19-position/dp/06R5630, 3 pages total.

"Oiyagai 5pcs HDMI Male Gold Plated 19 Pin Repair Plug Soldering Wire Type Connectors," Oiyagai, May 5, 2018, retrieved from https://www.amazon.com/Oiyagai-Plated-Repair-Soldering-Connectors/dp/B07CYJYL24, 9 pages total.

U.S. Office Action tor U.S. Appl. No. 29/776,430, dated Jul. 13, 2022.

* cited by examiner

CABLE CONNECTOR WITH IMPROVED SHIELDING PERFORMANCE

CROSS-REFERENCE TO RELATED APPLICATIONS

This patent application claims priority of a Chinese Patent Application No. 202011120990.4, filed on Oct. 19, 2020 and titled "ELECTRICAL CONNECTOR", and a Chinese Patent Application No. 202011332765.7, filed on Nov. 24, 2020 and titled "CABLE CONNECTOR", the entire content of which is incorporated herein by reference.

TECHNICAL FIELD

The present disclosure relates to a cable connector, which belongs to a technical field of connectors.

BACKGROUND

With the continuous improvement of data transmission quality requirements of electrical connectors, how to reduce the interference problem of conductive terminals during data transmission is a technical problem that needs to be solved by those skilled in the art.

In addition, in some cable connectors, the conductive terminals need to be connected with the cables, i.e., through soldering. As the density of conductive terminals of electrical connectors continues to increase, how to improve soldering efficiency while ensuring soldering quality is also a technical problem that needs to be solved by those skilled in the art.

SUMMARY

An object of the present disclosure is to provide a cable connector with better shielding performance.

In order to achieve the above object, the present disclosure adopts the following technical solution: a cable connector, including: a plurality of cables, each cable comprising a core wire, an insulating layer wrapped on the core wire and a shielding layer wrapped on the insulating layer, an electrical connector, the electrical connector comprising an insulating body, a plurality of conductive terminals and a shielding shell, each conductive terminal comprising a contact portion for mating with a mating connector and a tail portion connected with the core wire; and a ground shield, the ground shield being mounted to the cables, the ground shield being connected with the shielding layers of the cables, and the ground shield being connected with the shielding shell.

In order to achieve the above object, the present disclosure adopts the following technical solution: a cable connector, including: a plurality of cables, each cable comprising a core wire, an insulating layer wrapped on the core wire and a shielding layer wrapped on the insulating layer; an electrical connector, the electrical connector comprising an insulating body, a plurality of conductive terminals and a shielding shell, each conductive terminal comprising a contact portion and a tail portion, the tail portion being connected with corresponding core wire; and a ground shield, the ground shield being of a frame-shape configuration and defines a mounting slot through which the cables extend, and the ground shield being in contact with the shielding layers of the cables and being in contact with the shielding shell.

Compared with the prior art, the present disclosure improves the shielding performance of the cable connector by providing a ground shield, and connecting the ground shield, the shielding layers and the shielding shell together.

DETAILED DESCRIPTION

Figure 1:
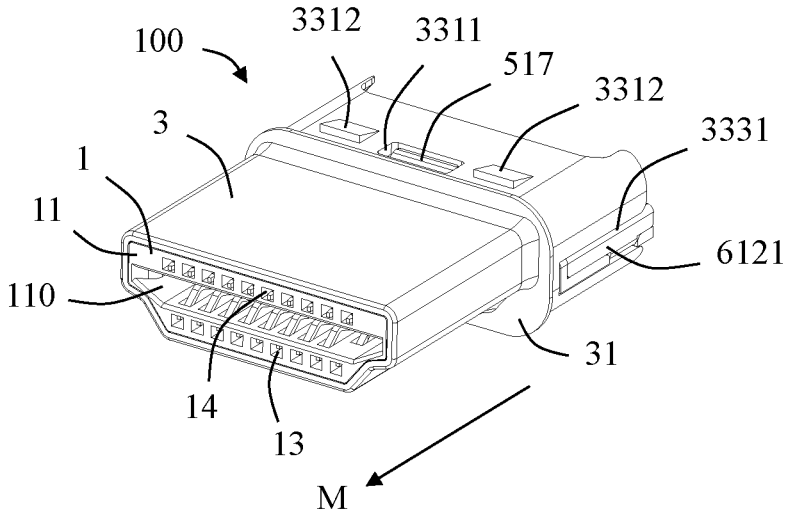
FIG. 1 is a perspective schematic view of a first electrical connector in accordance with an embodiment of the present disclosure.
Figure 2:
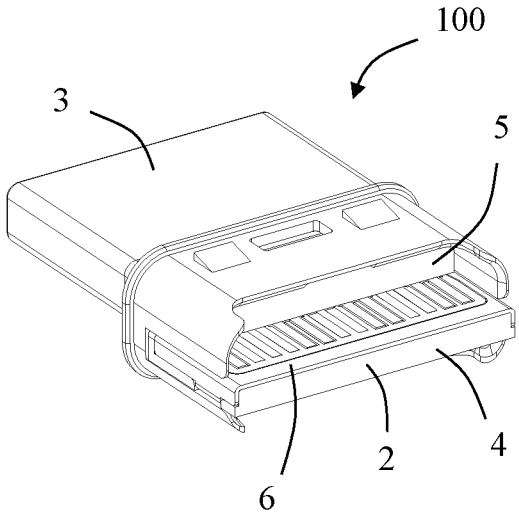
FIG. 2 is a perspective schematic view of FIG. 1 from another angle.

Exemplary embodiments will be described in detail here, examples of which are shown in drawings. When referring to the drawings below, unless otherwise indicated, same numerals in different drawings represent the same or similar elements. The examples described in the following exemplary embodiments do not represent all embodiments consistent with this application. Rather, they are merely examples of devices and methods consistent with some aspects of the application as detailed in the appended claims.

The terminology used in this application is only for the purpose of describing particular embodiments, and is not intended to limit this application. The singular forms "a", "said", and "the" used in this application and the appended claims are also intended to include plural forms unless the context clearly indicates other meanings.

It should be understood that the terms "first", "second" and similar words used in the specification and claims of this application do not represent any order, quantity or importance, but are only used to distinguish different components. Similarly, "an" or "a" and other similar words do not mean a quantity limit, but mean that there is at least one; "multiple" or "a plurality of" means two or more than two. Unless otherwise noted, "front", "rear", "lower" and/or "upper" and similar words are for ease of description only and are not limited to one location or one spatial orientation. Similar words such as "include" or "comprise" mean that elements or objects appear before "include" or "comprise" cover elements or objects listed after "include" or "comprise" and their equivalents, and do not exclude other elements or objects. The term "a plurality of" mentioned in the present disclosure includes two or more.

Hereinafter, some embodiments of the present disclosure will be described in detail with reference to the accompanying drawings. In the case of no conflict, the following embodiments and features in the embodiments can be combined with each other.

Referring to FIGS. 1 to 12, the present disclosure discloses a first electrical connector 100 including a first insulating body 1, a terminal module 2 at least partially installed in the first insulating body 1 and a first shielding shell 3 enclosing the first insulating body 1. In the illustrated embodiment of the present disclosure, the first electrical connector 100 is an HDMI connector. The first electrical connector 100 is adapted to connect with a plurality of cables 200. The first electrical connector 100 is adapted to mate with a mating connector (not shown) along a mating direction M so as to realize data transmission. Of course, it is understandable to those skilled in the art that in other embodiments, the first electrical connector 100 may also be another type of the electrical connector.

Figure 10:
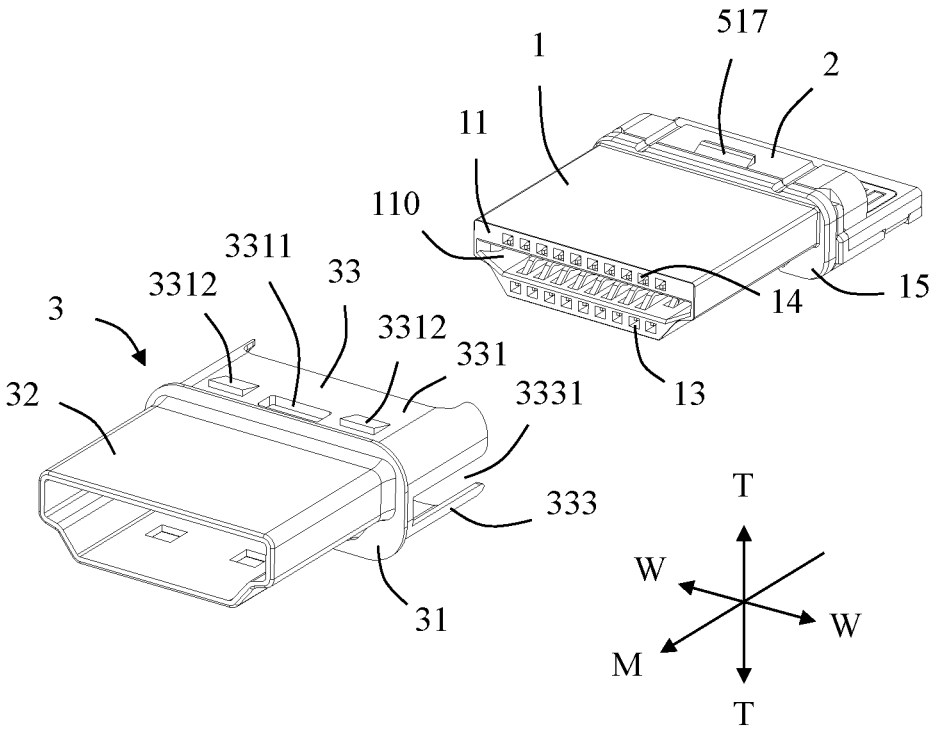
FIG. 10 is a partially exploded perspective view of FIG. 1.
Figure 11:
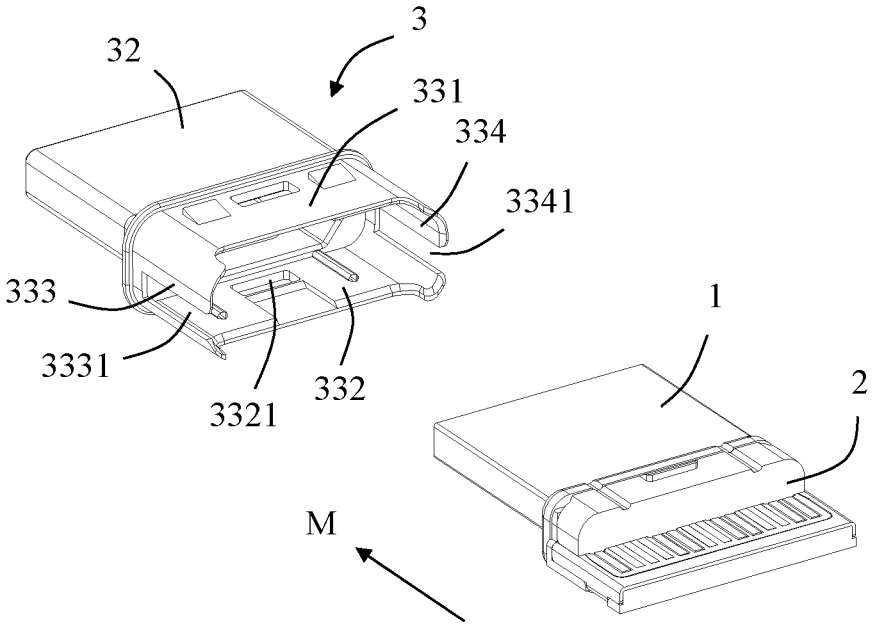
FIG. 11 is a partially exploded perspective view of FIG. 10 from another angle.

Referring to FIGS. 7 to 12, in the illustrated embodiment of the present disclosure, the first shielding shell 3 has a one-piece structure made of a metal material. The first shielding shell 3 includes a flange portion 31, a mating portion 32 extending from the flange portion 31 in the mating direction M, and a retaining portion 33 extending from the flange portion 31 in a direction opposite to the mating direction M. In the illustrated embodiment of the present disclosure, the mating portion 32 has an appearance and size that comply with the HDMI standard. The flange portion 31 protrudes from the mating portion 32 to an outer periphery so as to be able to play a limiting role and prevent the mating portion 32 from being excessively inserted into the mating connector. The retaining portion 33 includes a top wall 331, a bottom wall 332 opposite to the top wall 331, a first side wall portion 333 which connects the top wall 331 and the bottom wall 332 and is located on one side, and a second side wall portion 334 which connects the top wall 331 and the bottom wall 332 and located on the other side. The bottom wall 332 includes a first locking hole 3321 and a plurality of first protrusions 3322 located on both sides of the first locking hole 3321 (referring to FIGS. 11 and 7). The top wall 331 includes a second locking hole 3311 and a plurality of second protrusions 3312 located on both sides of the second locking hole 3311 (referring to FIG. 10). Both the first locking hole 3321 and the second locking hole 3311 are adapted to lock the terminal module 2 so as to prevent the terminal module 2 from being separated from the first shielding shell 3. An upper concept of the first protrusion 3322 and/or the second protrusion 3312 is a protrusion. Referring to FIG. 11, the first side wall portion 333 includes a first notch 3331 extending through the retaining portion 33 in a direction opposite to the mating direction M. The second side wall portion 334 includes a second notch 3341 extending through the retaining portion 33 in a direction opposite to the mating direction M.

Figure 3:
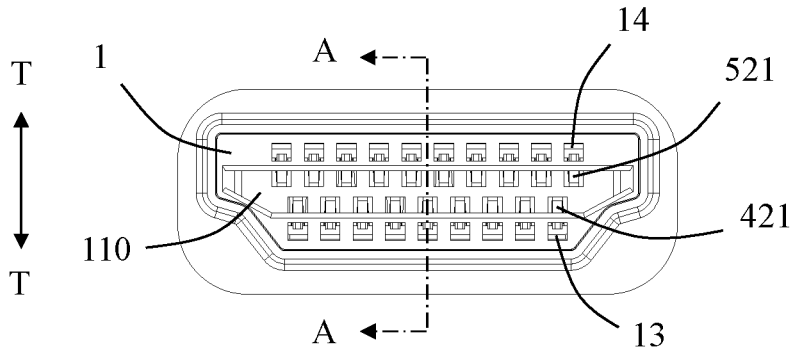
FIG. 3 is a front view of FIG. 1.
Figure 4:
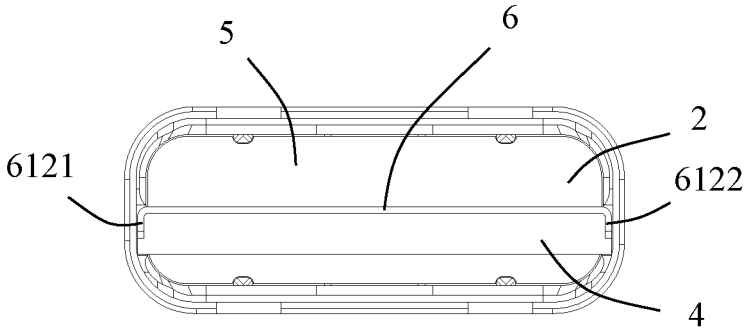
FIG. 4 is a rear view of FIG. 1.
Figure 5:
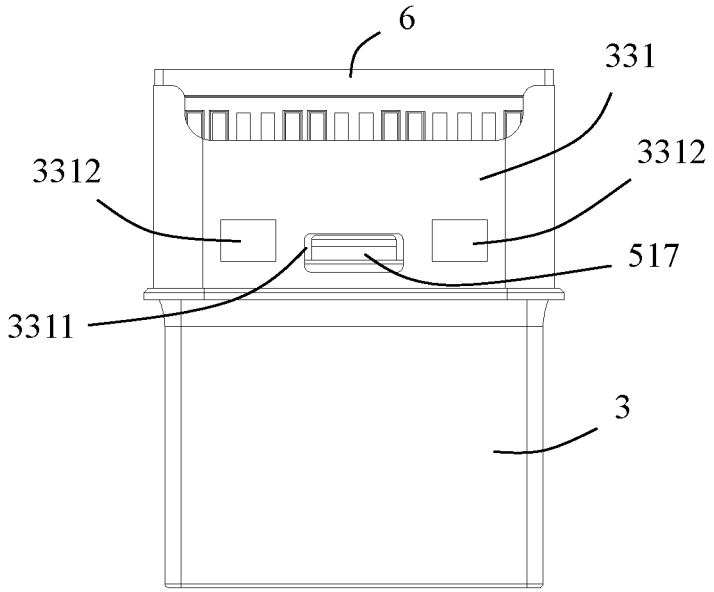
FIG. 5 is a left side view of FIG. 1.
Figure 6:
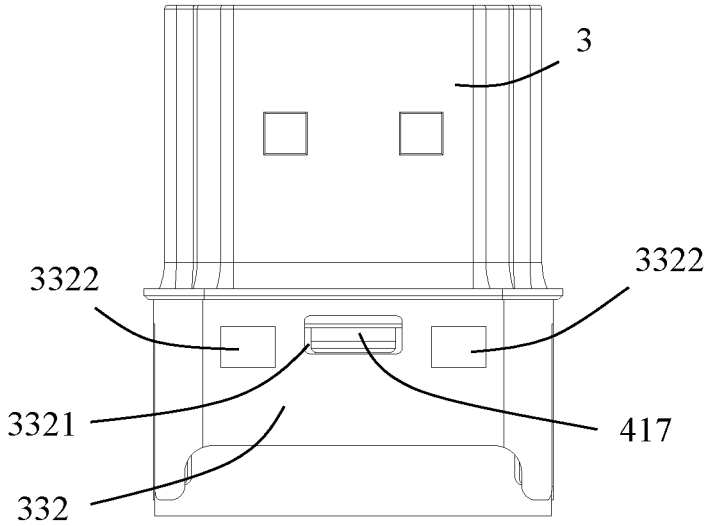
FIG. 6 is a right side view of FIG. 1.
Figure 7:
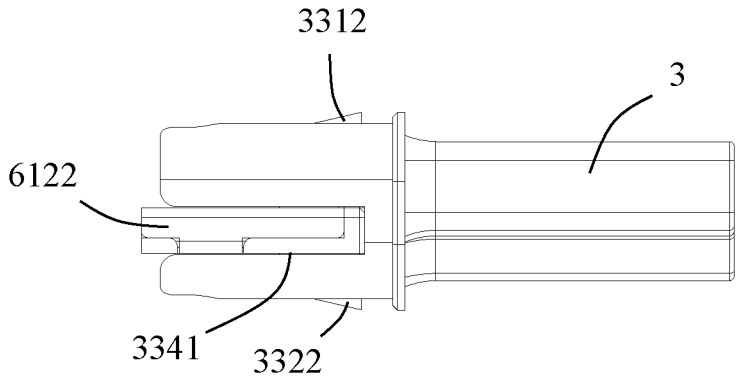
FIG. 7 is a top view of FIG. 1.
Figure 8:
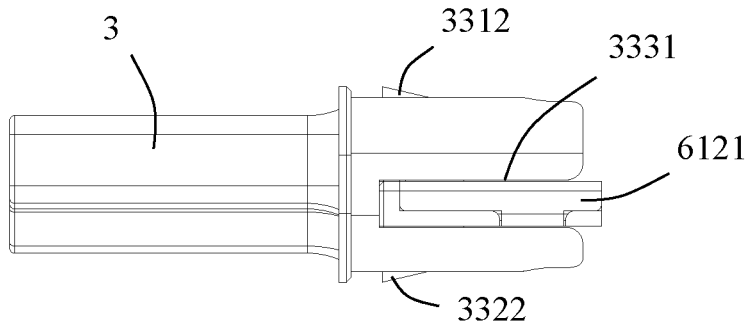
FIG. 8 is a bottom view of FIG. 1.
Figure 9:
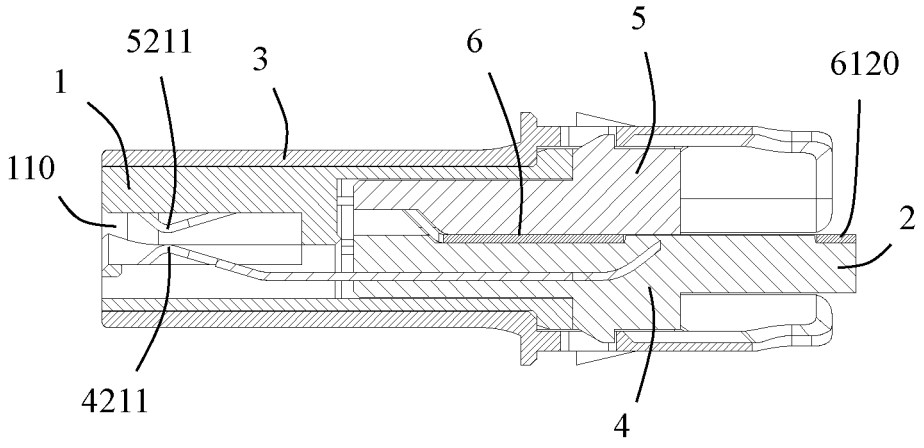
FIG. 9 is a schematic cross-sectional view taken along line A-A in FIG. 3.
Figure 12:
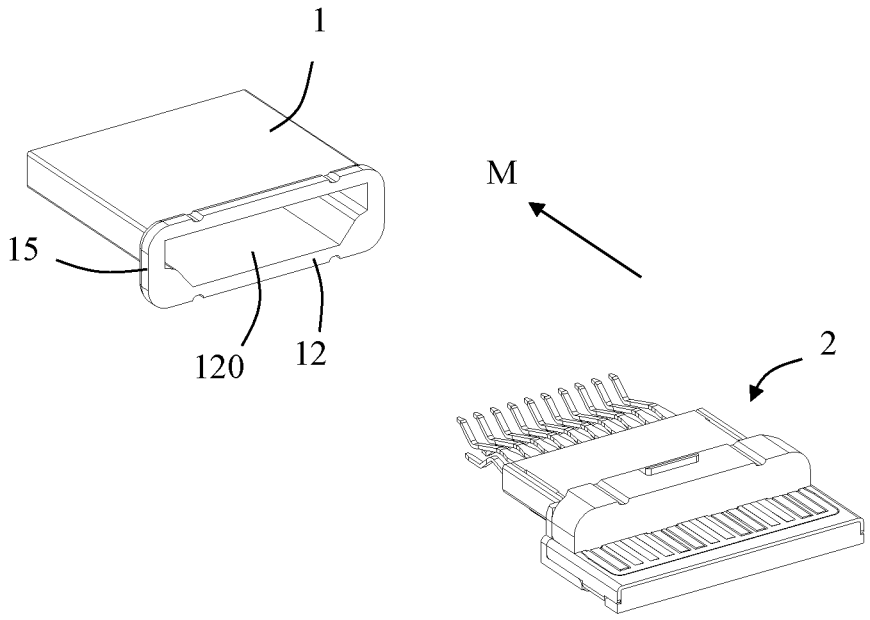
FIG. 12 is an exploded perspective view of a terminal module and a first insulating body in FIG. 11.

Referring to FIGS. 10 and 12, the first insulating body 1 includes a mating surface 11, a mating slot 110 extending through the mating surface 11, a mounting surface 12 opposite to the mating surface 11 and an installation space 120 extending through the mounting surface 12. The terminal module 2 is installed in the installation space 120 along the mating direction M from the mounting surface 12. The first insulating body 1 extends along its thickness direction T-T (i.e., a top-bottom direction) and a width direction W-W (i.e., a left-right direction). In addition, the first insulating body 1 further includes a plurality of first terminal receiving slots 13 communicating with the mating slot 110, and a plurality of second terminal receiving slots 14 communicated with the mating slot 110. In the illustrated embodiment of the present disclosure, the first terminal receiving slots 13 and the second terminal receiving slots 14 are respectively located on opposite sides (i.e., a lower side and an upper side) of the mating slot 110 along the thickness direction T-T of the first insulating body 1. The first terminal receiving slots 13 and the second terminal receiving slots 14 are staggered along the thickness direction T-T of the first insulating body 1 (as shown in FIG. 3). In the illustrated embodiment of the present disclosure, the first terminal receiving slots 13 and the second terminal receiving slots 14 further extend through the mating surface 11 along the mating direction M. With this arrangement, on one hand, the first terminal receiving slots 13 and the second terminal receiving slots 14 can be designed to be longer, thereby facilitating the installation of the terminal module 2; on the other hand, it can provide better heat dissipation to the conductive terminals of the terminal module 2.

Referring to FIG. 10, in the illustrated embodiment of the present disclosure, the first insulating body 1 further includes a protruding portion 15 adjacent to the mounting surface 12 and arranged around. On one hand, the protruding portion 15 can play a limiting role when the first insulating body 1 is mated with the first shielding shell 3; on the other hand, the protruding portion 15 can also play a limiting role when the terminal module 2 is mated with the first insulating body 1.

Figure 13:
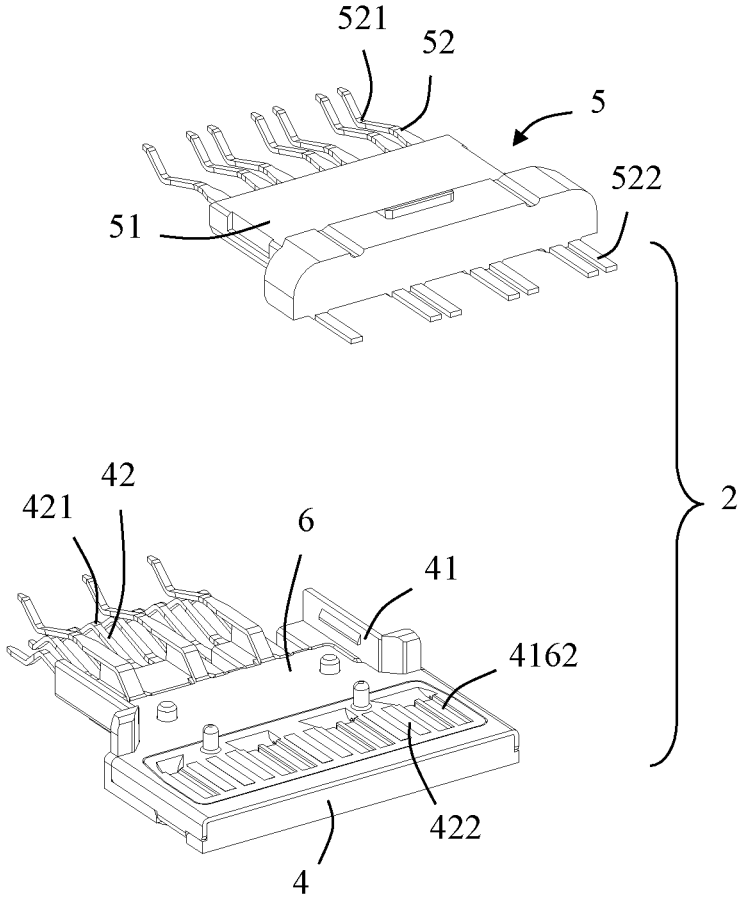
FIG. 13 is a partial perspective exploded view of the terminal module in FIG. 12.
Figure 14:
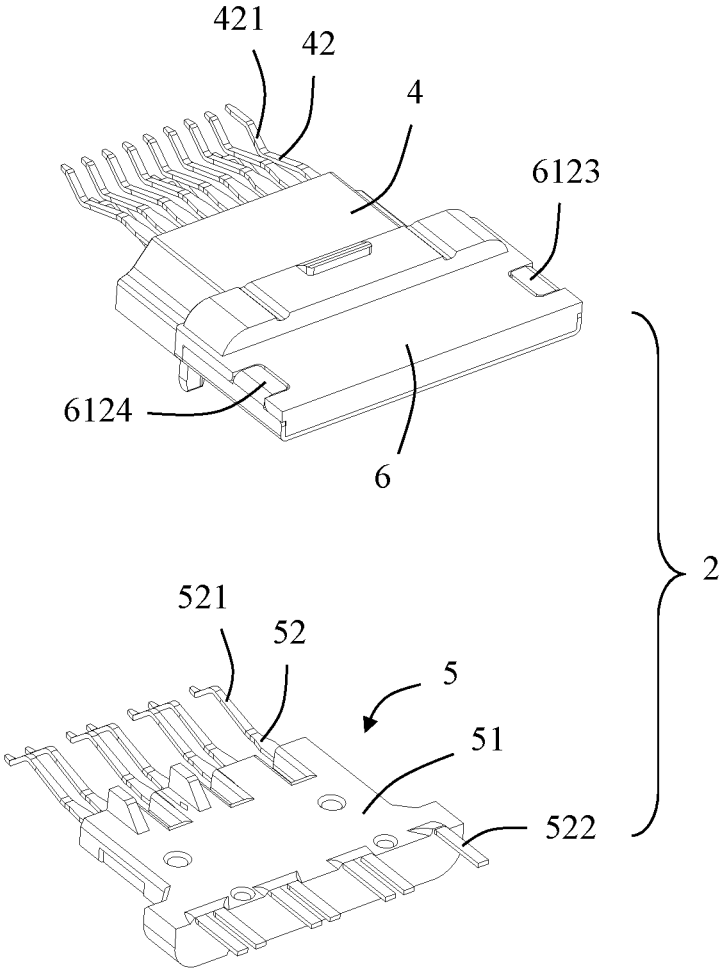
FIG. 14 is a partially exploded perspective view of FIG. 13 from another angle.

Referring to FIGS. 12 to 14, the terminal module 2 includes a first terminal module 4, a second terminal module 5, and a shielding piece 6 is at least partially clamped between the first terminal module 4 and the second terminal module 5.

Figure 15:
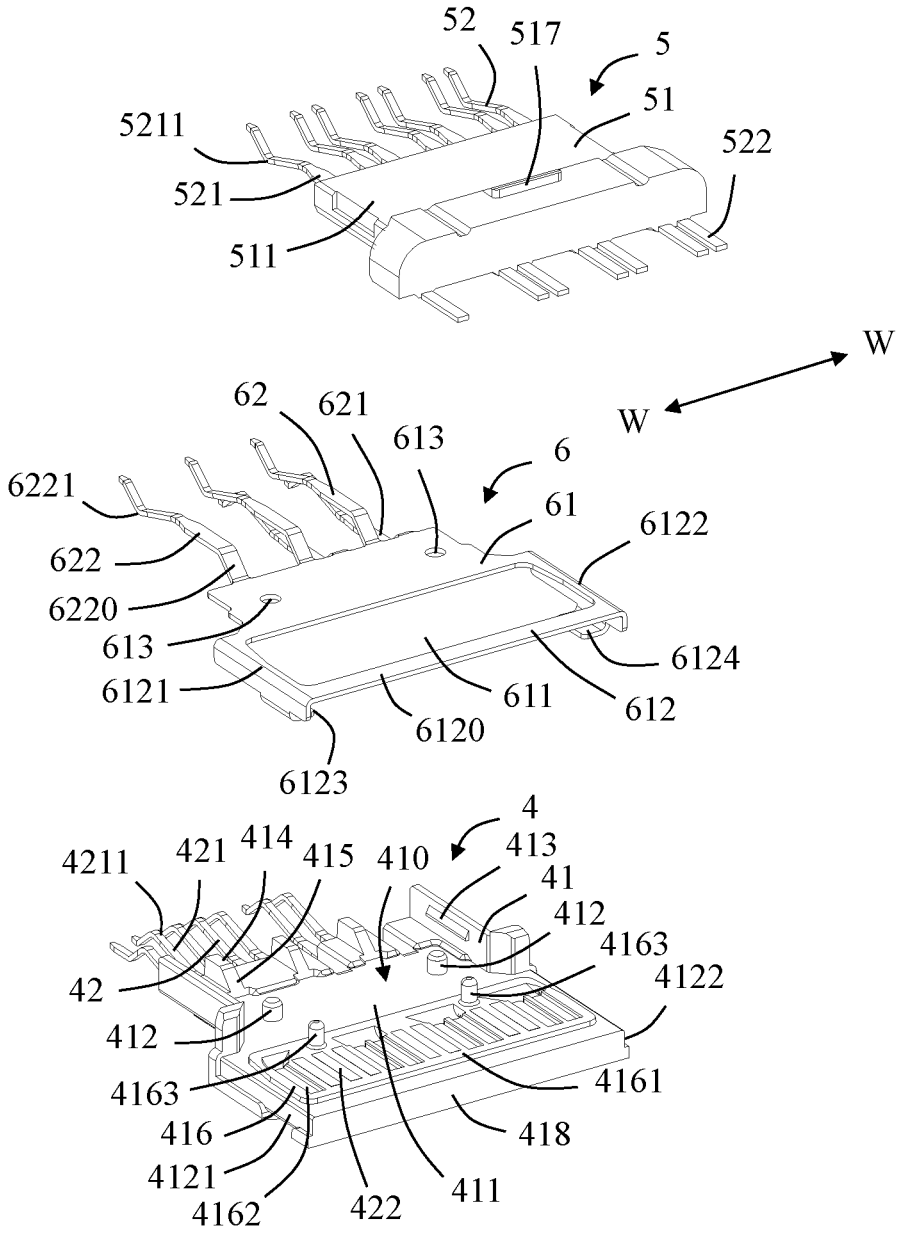
FIG. 15 is a further perspective exploded view of FIG. 13.
Figure 16:
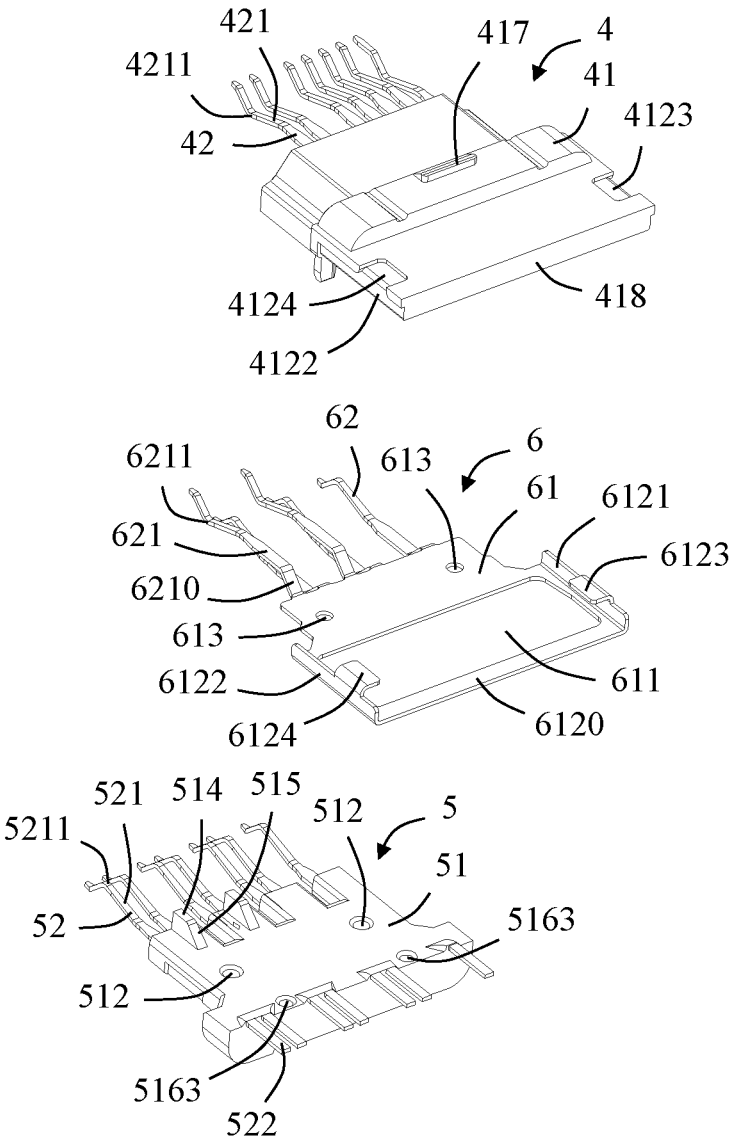
FIG. 16 is a further perspective exploded view of FIG. 14.

Referring to FIGS. 15 and 16, the first terminal module 4 includes a first insulating block 41 and a plurality of first conductive terminals 42 fixed to the first insulating block 41. In the illustrated embodiment of the present disclosure, the plurality of first conductive terminals 42 are insert-molded with the first insulating block 41. Of course, in other embodiments, the plurality of first conductive terminals 42 may also be fixed to the first insulating block 41 by assembling. Similarly, the second terminal module 5 includes a second insulating block 51 and a plurality of second conductive terminals 52 fixed to the second insulating block 51. In the illustrated embodiment of the present disclosure, the plurality of second conductive terminals 52 are insert-molded with the second insulating block 51. Of course, in other embodiments, the plurality of second conductive terminals 52 may also be fixed to the second insulating block 51 by assembling.

The first insulating block 41 includes a first base 411 and an extension 418 extending backwardly from the first base 411. The first base 411 includes a receiving space 410 for receiving the second insulating block 51, a plurality of first positioning posts 412 protruding into the receiving space 410 and a plurality of first ribs 413 protruding into the receiving space 410. Referring to FIG. 15, the first insulating block 41 further includes a first supporting protrusion 414. The first supporting protrusion 414 includes a first supporting inclined surface 415.

The extension 418 includes a raised platform 416. The raised platform 416 includes an assembly surface 4161 and a plurality of receiving grooves 4162 recessed from the assembly surface 4161. In addition, the raised platform 416 also includes a plurality of second positioning posts 4163 extending toward the second insulating block 51. The extension 418 includes a first recessed portion 4121 and a second recessed portion 4122 on both sides thereof. The extension 418 further includes a first recess 4123 connected to the first recessed portion 4121, and a second recess 4124 connected to the second recessed portion 4122. The first recess 4123 and the second recess 4124 are located on opposite sides of the extension 418 from the assembly surface 4161. The first recessed portion 4121, the second recessed portion 4122, the first recess 4123 and the second recess 4124 are all used to mate with the shielding piece 6. The first insulating block 41 further includes a first locking protrusion 417 located on the same surface as the first recess 4123 and the second recess 4124. The first locking protrusion 417 is adapted to be locked in the first locking hole 3321.

The first conductive terminal 42 includes a first elastic contact arm 421 extending beyond the first insulating block 41 and a first tail portion 422 disposed opposite to the first elastic contact arm 421. The first elastic contact arm 421 has a cantilever shape and extends into the mating slot 110. The first elastic contact arm 421 includes a first contact portion 4211 for electrically connecting with the mating connector.

The second insulating block 51 includes a second base 511. The second base 511 is received in the receiving space 410 of the first insulating block 41. Two sides of the second base 511 interfere with the first rib 413 respectively, so as to improve the holding force therebetween and prevent loosening. The second base 511 includes a plurality of first positioning holes 512 mating with the first positioning posts 412 and a plurality of second positioning holes 5163 mating with the second positioning posts 4163. Referring to FIG. 16, the second insulating block 51 further includes a second supporting protrusion 514. The second supporting protrusion 514 includes a second supporting inclined surface 515. The second insulating block 51 further includes a second locking protrusion 517. The second locking protrusion 517 is adapted to be locked in the second locking hole 3311.

The second conductive terminal 52 includes a second elastic contact arm 521 extending beyond the second insulating block 51 and a second tail portion 522 disposed opposite to the second elastic contact arm 521. The second elastic contact arm 521 has a cantilever shape and extends into the mating slot 110. The second elastic contact arm 521 includes a second contact portion 5211 for electrically connecting with the mating connector. The first contact portion 4211 and the second contact portion 5211 extend toward the middle. That is, the first contact portion 4211 protrudes toward the second contact portion 5211, and the second contact portion 5211 protrudes toward the first contact portion 4211. With this arrangement, the first contact portion 4211 and the second contact portion 5211 can jointly clamp a tongue plate (not shown) of the mating connector. The second tail portion 522 extends beyond the second insulating block 51 in a direction opposite to the mating direction M.

In the illustrated embodiment of the present disclosure, the shielding piece 6 is made of a metal material and has a one-piece structure. The shielding piece 6 includes a connecting portion 61 located between the plurality of first conductive terminals 42 and the plurality of second conductive terminals 52, and a plurality of ground terminals 62 extending from the connecting portion 61. The connecting portion 61 includes an opening 611, a frame 612 surrounding the opening 611, and a plurality of mounting holes 613 for mating with the first positioning posts 412. The frame 612 includes a first side wall 6121, a second side wall 6122 parallel to the first side wall 6121, and a transverse wall 6120 connecting the first side wall 6121 and the second side wall 6122. The first side wall 6121 is located in the first notch 3331 and is electrically connected with the first shielding shell 3. The second side wall 6122 is located in the second notch 3341 and is electrically connected with the first shielding shell 3. With this arrangement, the shielding piece 6 and the first shielding shell 3 can be connected as a whole, thereby increasing the grounding area and improving the shielding effect. In an embodiment of the present disclosure, the first side wall 6121 is interference-fitted in the first notch 3331 so as to be electrically connected with the first shielding shell 3. The second side wall 6122 is interference-fitted in the second notch 3341 so as to be electrically connected with the first shielding shell 3. With this arrangement, the soldering step can be omitted through interference fit. In addition, the shielding piece 6 further includes a first tab portion 6123 extending from the first side wall 6121 and a second tab portion 6124 extending from the second side wall 6122. The first tab portion 6123 and the second tab portion 6124 are used to mate with the first recess 4123 and the second recess 4124, respectively, so as to more reliably fix the shielding piece 6 on the first insulating block 41.

Figure 17:
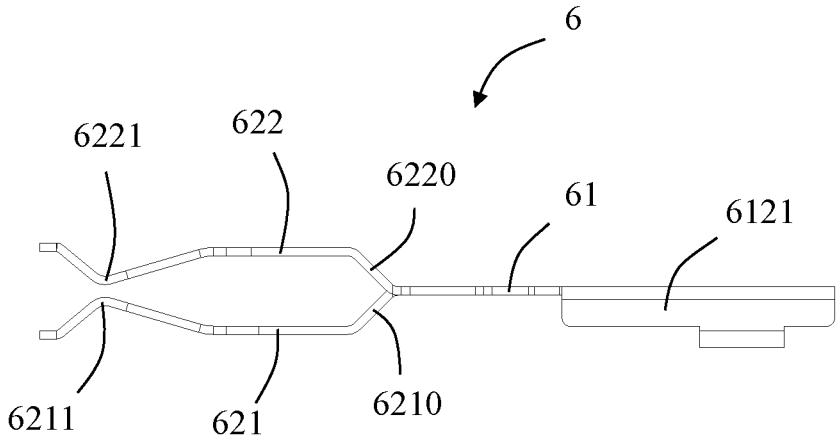
FIG. 17 is a left side view of the shielding piece in FIG. 15.

The plurality of ground terminals 62 include a plurality of first ground elastic arms 621 arranged in a same row as the first elastic contact arms 421, and a plurality of second ground elastic arms 622 arranged in a same row as the second elastic contact arms 521. The first ground elastic arm 621 includes a first contacting portion 6211 and a first inclined root portion 6210 connected to the connecting portion 61. The first inclined root portion 6210 is supported on the second supporting inclined surface 515. The second ground elastic arm 622 includes a second contacting portion 6221 and a second inclined root portion 6220 connected to the connecting portion 61. The second inclined root portion 6220 is supported on the first supporting inclined surface 415. Such a configuration can provide better root support for the first ground elastic arms 621 and the second ground elastic arms 622, thereby helping to improve reliability. In the illustrated embodiment of the present disclosure, the first ground elastic arms 621 and the second ground elastic arms 622 are arranged along the width direction W-W of the first insulating body 1. Inclined directions of the first ground elastic arms 621 and the second ground elastic arms 622 are different (referring to FIG. 17).

The first insulating block 41 and the second insulating block 51 include locking structures that cooperate with each other so that at least a part of the connecting portion 61 can be clamped between the first insulating block 41 and the second insulating block 51. In the illustrated embodiment of the present disclosure, the locking structures include, but is not limited to, the first positioning posts 412 and the first positioning holes 512, and the second positioning posts 4163 and the second positioning holes 5163.

Steps of assembling the terminal module 2 of the present disclosure are as follows: firstly, the first conductive terminals 42 are insert-molded with the first insulating block 41 so as to form the first terminal module 4; and the second conductive terminals 52 are insert-molded with the second insulating block 51 so as to form the second terminal module 5; secondly, the shielding piece 6 is mounted on the first terminal module 4, in which the mounting holes 613 of the connecting portion 61 is sleeved on the first positioning posts 412, and the first side wall 6121 and the second side wall 6122 are retained in the first recessed portion 4121 and the second recessed portion 4122, respectively. Then, the first tab portion 6123 and the second tab portion 6124 are bent so that they are retained in the first recess 4123 and the second recess 4124, respectively. At this time, the opening 611 is sleeved on the raised platform 416. Finally, the first terminal module 4 and the second terminal module 5 are assembled together as a whole. At this time, the connecting portion 61 is located between the first insulating block 41 and the second insulating block 51 along the thickness direction T-T of the first insulating body 1. The frame 612 is located at a periphery of the first tail portions 422 and the second tail portions 522. That is, the first tail portions 422 and the second tail portions 522 are in the opening 611 and not in contact with the frame 612. The first tail portions 422 and the second tail portions 522 are exposed on the assembly surface 4161.

In the illustrated embodiment of the present disclosure, none of the plurality of first conductive terminals 42 and the plurality of second conductive terminals 52 includes a terminal with grounding function. The terminals having the grounding function (i.e., the ground terminals 62) are all formed on the shielding piece 6.

Figure 18:
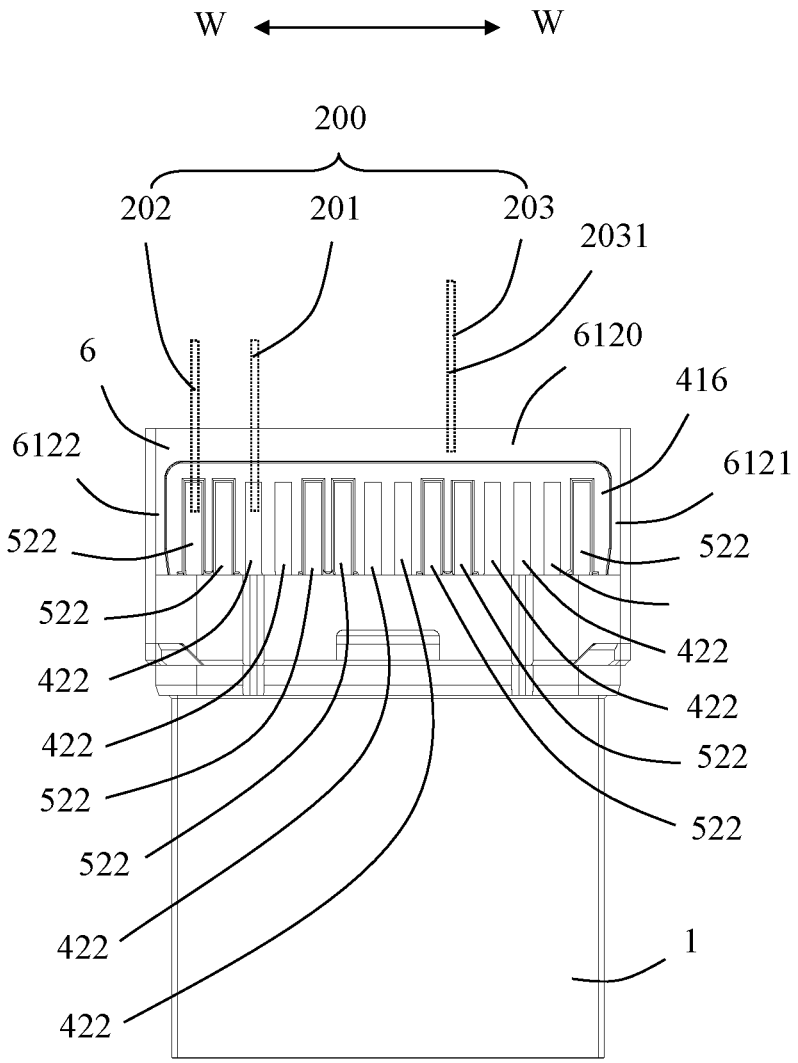
FIG. 18 is a top view of the terminal module and the first insulating body in FIG. 11 when they are installed together.
Figure 19:
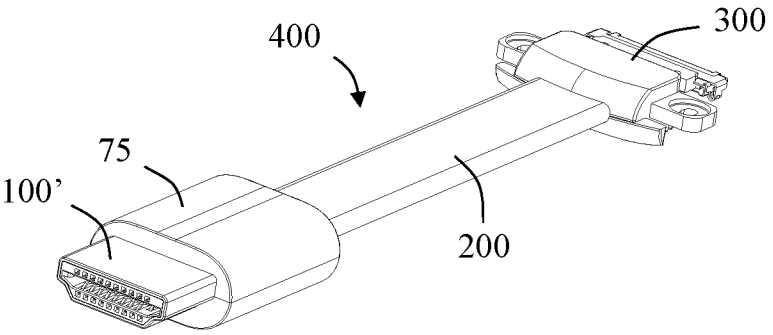
FIG. 19 is a perspective schematic view of a cable connector in accordance with an embodiment of the present disclosure.
Figure 20:
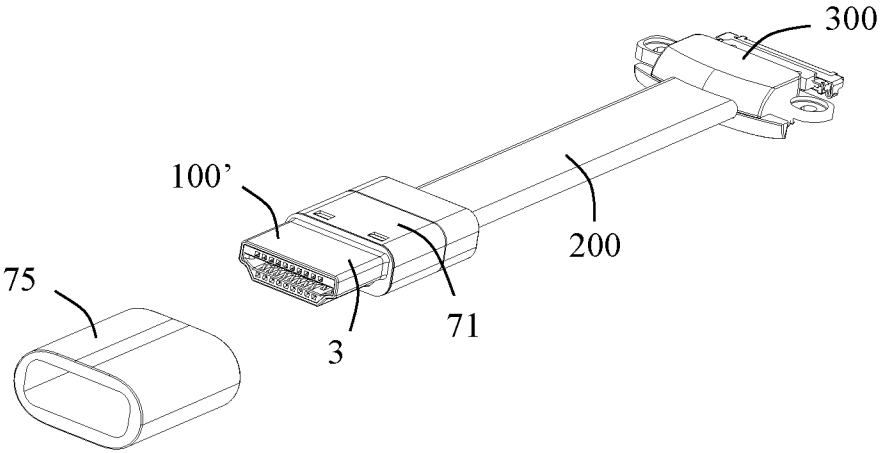
FIG. 20 is a partially exploded perspective view of FIG. 19.
Figure 21:
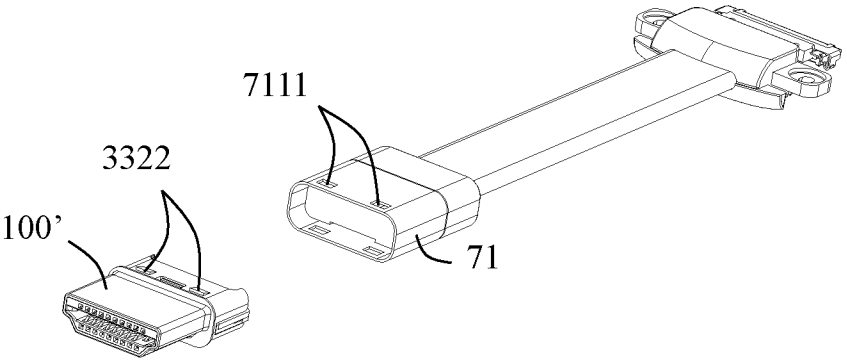
FIG. 21 is a further perspective exploded view after removing an outer housing in FIG. 19.
Figure 22:
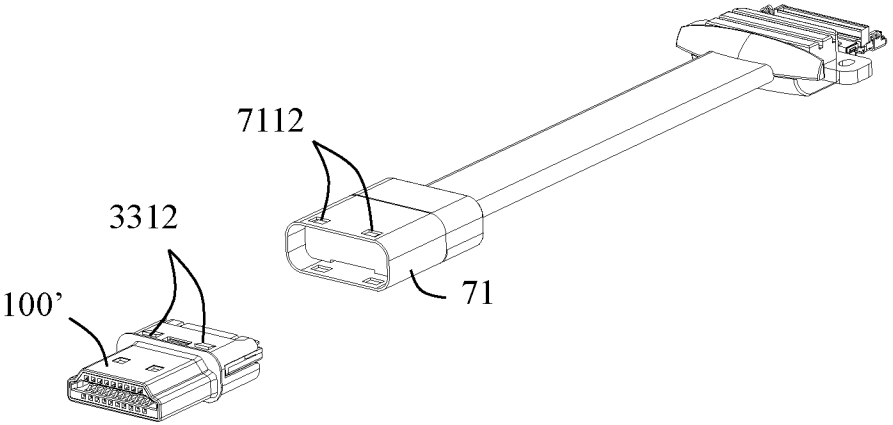
FIG. 22 is a partially exploded perspective view of FIG. 21 from another angle.
Figure 23:
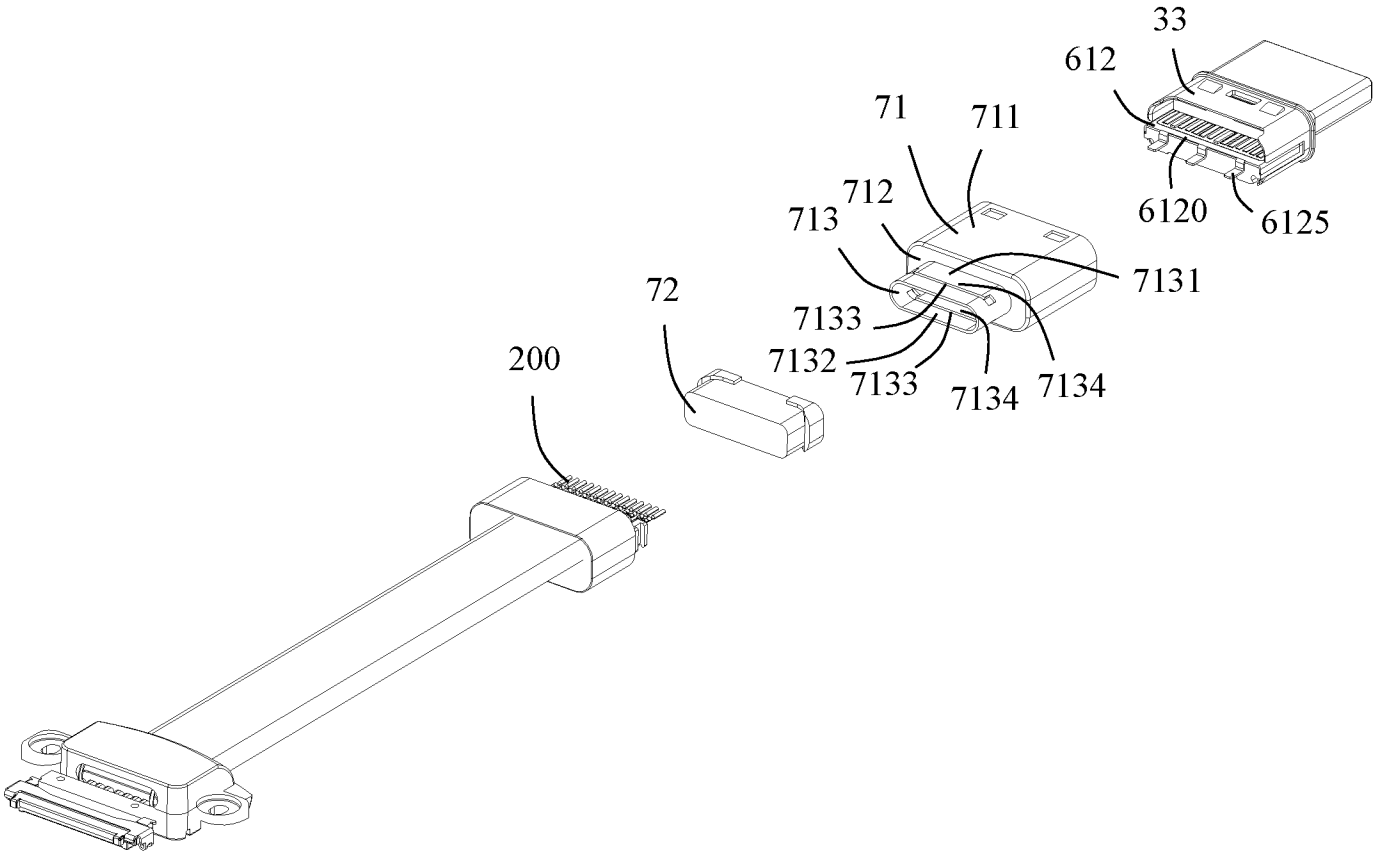
FIG. 23 is a partial perspective exploded view of the cable connector of the present disclosure after the outer housing is removed.
Figure 24:
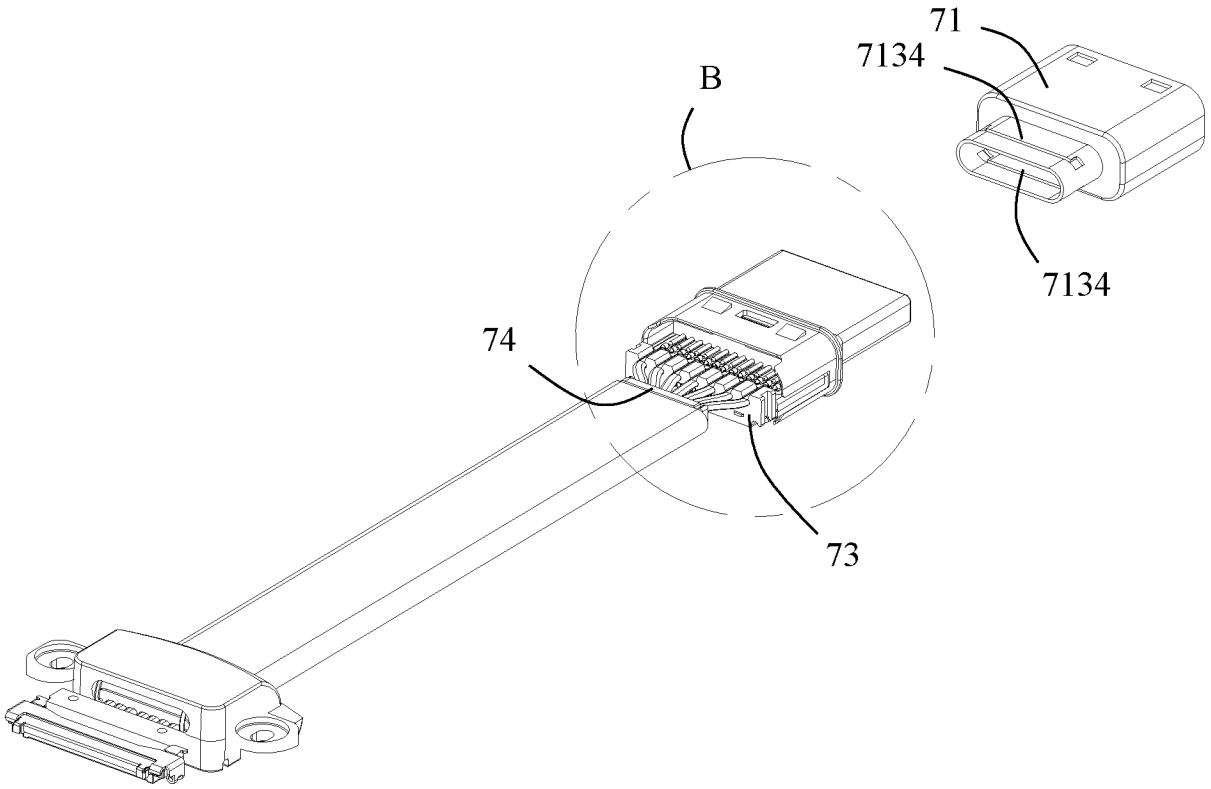
FIG. 24 is a schematic view of the cable connector of the present disclosure after the outer housing is removed and a second shielding shell is separated.

Referring to FIG. 18, the first tail portions 422 and the second tail portions 522 are interspersedly arranged in a row along the width direction W-W of the first insulating body 1. Among the first tail portions 422 and the second tail portions 522 in the row, any two adjacent ones are two first tail portions 422, or two second tail portions 522, or one first tail portion 422 and one second tail portion 522. In other words, only the first tail portions 422 of the first conductive terminals 42 and the second tail portions 522 of the second conductive terminals 52 occupy the width of the raised platform 416 (that is, no other ground terminals occupy the width of the raised platform 416). With this arrangement, under the development trend that the conductive terminals of the electrical connector are becoming more and more dense, this design can more conveniently arrange the conductive terminals and reduce the risk of short circuits among the conductive terminals. In addition, this design can also simplify the design and manufacture of the conductive terminals, and reduce the increase in material cost and manufacturing cost caused by the continuous widening of the tail portions of the conductive terminals to both sides.

Figure 25:
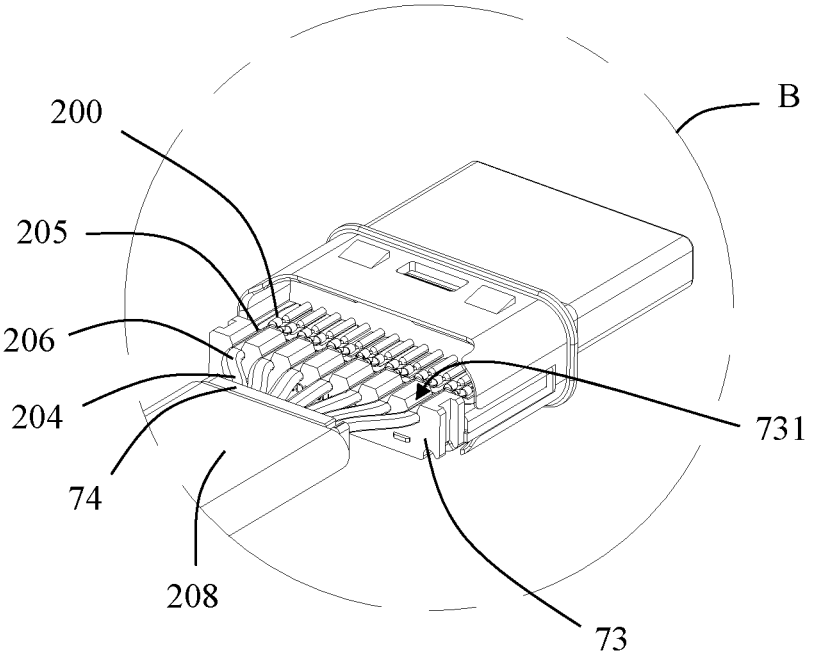
FIG. 25 is a partial enlarged view of a circled portion B in FIG. 24.
Figure 26:
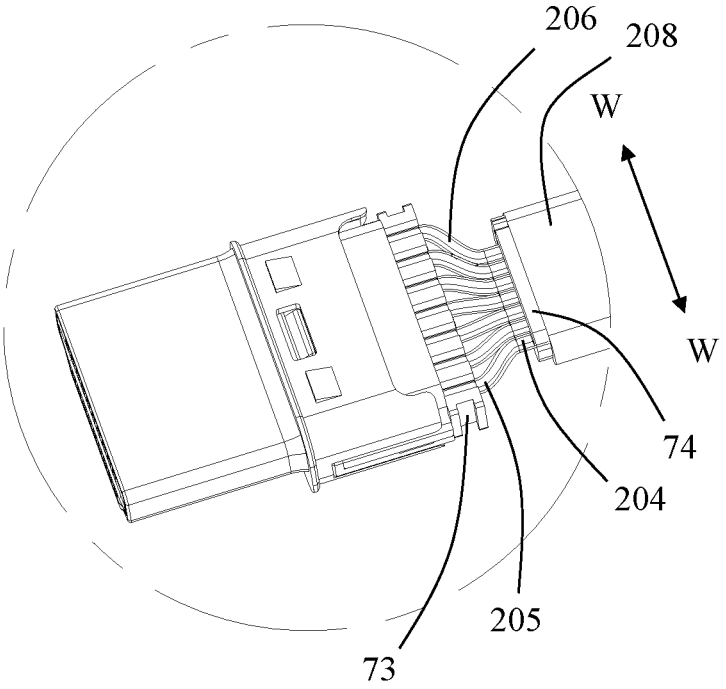
FIG. 26 is a partial enlarged view of FIG. 25 from another angle.

In an embodiment of the present disclosure, the first tail portions 422 are adapted to connect with first signal cables 201. The second tail portions 522 are adapted to connect with second signal cables 202. The frame 612 is adapted to connect with a cable grounding portion 203. In an embodiment of the present disclosure, the cable grounding portion 203 is formed by a grounding cable 2031 (as shown in FIG. 18). In another embodiment of the present disclosure, the cable grounding portion 203 is formed by the shielding layers 206 of the first signal cables 201 and the second signal cables 202 (as shown in FIGS. 25 and 26). In an embodiment of the present disclosure, the transverse wall 6120 is adapted to connect with the cable grounding portion 203. The cables 200 include the first signal cables 201, the second signal cables 202, and the ground cable 2031.

The present disclosure avoids problems such as poor contact caused by connecting various grounding terminals in series in the related art, by providing the integral shielding piece 6, which ensures the grounding reliability. In addition, the shielding piece 6 located between the first terminal module 4 and the second terminal module 5 greatly reduce the mutual interference of signals between the upper and lower layers when the first conductive terminal 42 and the second conductive terminal 52 are transmitting data, therefore it is beneficial to keep high-frequency and high-fidelity signal transmission. By arranging the first tail portions 422 and the second tail portions 522 in a single row, the connection to the cables can be completed by one soldering. As a result, it reduces the difficulty of soldering, improves the reliability of soldering and the stability of performance, and avoids the accumulation of defects due to multiple soldering. In addition, based on the soldering process used in this structure, it can be compatible with coaxial and twisted core wires at the same time, thereby expanding the scope of application.

Referring to FIGS. 19 to 36, an embodiment of the present disclosure discloses a cable connector 400. The cable connector 400 includes a first electrical connector 100', a cable 200, and a second electrical connector 300. The first electrical connector 100' and the second electrical connector 300 are connected at two ends of the cable 200, respectively.

The first electrical connector 100' is basically the same as the first electrical connector 100 shown in FIGS. 1 to 18. The difference is that the frame 612 of the first electrical connector 100' also includes a plurality of L-shaped support portions 6125 extending from the transverse wall 6120 (referring to FIG. 23).

The cable connector 400 further includes a second shielding shell 71 connected to the first shielding shell 3, a covering block 72 molded on the connection positions of the cable 200 and the first conductive terminals 42, the second conductive terminals 52 and the shielding piece 6, a conductive wire clamp 73 installed on the supporting portions 6125 and used to mate with the cable 200, a conductive element 74 installed on the cable 200, and an outer housing 75 over-molded on the first electrical connector 100'. The outer housing 75 is made of an insulating material.

Referring to FIGS. 20 to 24, the second shielding shell 71 includes a cylindrical portion 711, an end wall 712 located at one end of the cylindrical portion 711, and an extension portion 713 integrally extending from the end wall 712 in a direction away from the cylindrical portion 711. The cylindrical portion 711 includes a first opening 7111 and a second opening 7112 which are mated with the first protrusion 3322 and the second protrusion 3312. The upper concept of the first opening 7111 and/or the second opening 7112 is an opening. Of course, in other embodiments, it is understandable to those skilled in the art that the position of the protrusion and the opening can also be exchanged. In the illustrated embodiment of the present disclosure, by locking the first shielding shell 3 and the second shielding shell 71, laser soldering can be used instead of solder during soldering. Therefore, efficiency is improved and the connection strength between the first shielding shell 3 and the second shielding shell 71 is enhanced.

During installation, the cylindrical portion 711 is sleeved on the retaining portion 33. The flange portion 31 can limit the installation of the cylindrical portion 711. The cylindrical portion 711 surrounds the circumference of the connection positions of the cable 200 with the first conductive terminals 42, the second conductive terminals 52 and the shielding piece 6, thereby playing a shielding role. The end wall 712 can partially close the internal space formed by the cylindrical portion 711, thereby improving the shielding effect.

The extension portion 713 is in a contracted shape compared to the cylindrical portion 711. The extension portion 713 has a hollow ring shape and includes a top surface 7131 and a bottom surface 7132 opposite to the top surface 7131. Each of the top surface 7131 and the bottom surface 7132 includes a slot 7133 located approximately in the middle and a crimping portion 7134 protruding into the slot 7133.

Figure 27:
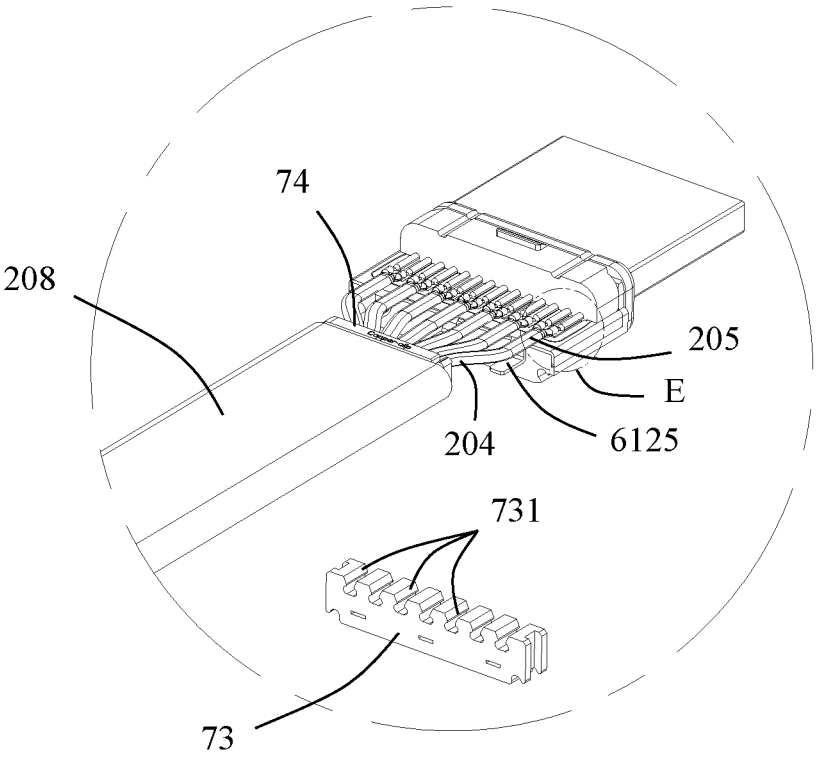
FIG. 27 is a partially exploded perspective view of FIG. 25, in which a conductive wire clamp is separated.

Referring to FIGS. 25 to 27, the cable 200 includes a first cable segment 204 at one end thereof and a second cable segment 205 extending from the first cable segment 204. A width of the first cable segment 204 along the width direction W-W of the first insulating body 1 is different from a width of the second cable segment 205 along the width direction W-W of the first insulating body 1. In the illustrated embodiment of the present disclosure, the cables of the first cable segment 204 are gathered along the width direction W-W of the insulating body 1. The cables of the second cable segment 205 are spread out along the width direction W-W of the insulating body 1. That is, the width of the first cable segment 204 in the width direction W-W of the insulating body 1 is smaller than the width of the second cable segment 205 in the width direction W-W of the insulating body 1. Ire the illustrated embodiment of the present disclosure, at the position where the first cable segment 204 is located, the cables are close to each other and at the position where the second cable segment 205 is located, the cables are separated from each other. By providing the second cable segment 205, the distances between the cable 200 and the connection positions of the first conductive terminals 42, the second conductive terminals 52 and the shielding piece 6 are effectively increased, thereby avoiding short circuit. In addition, by increasing the distances, it is also beneficial for soldering, and improving the soldering quality and efficiency.

Figure 37:
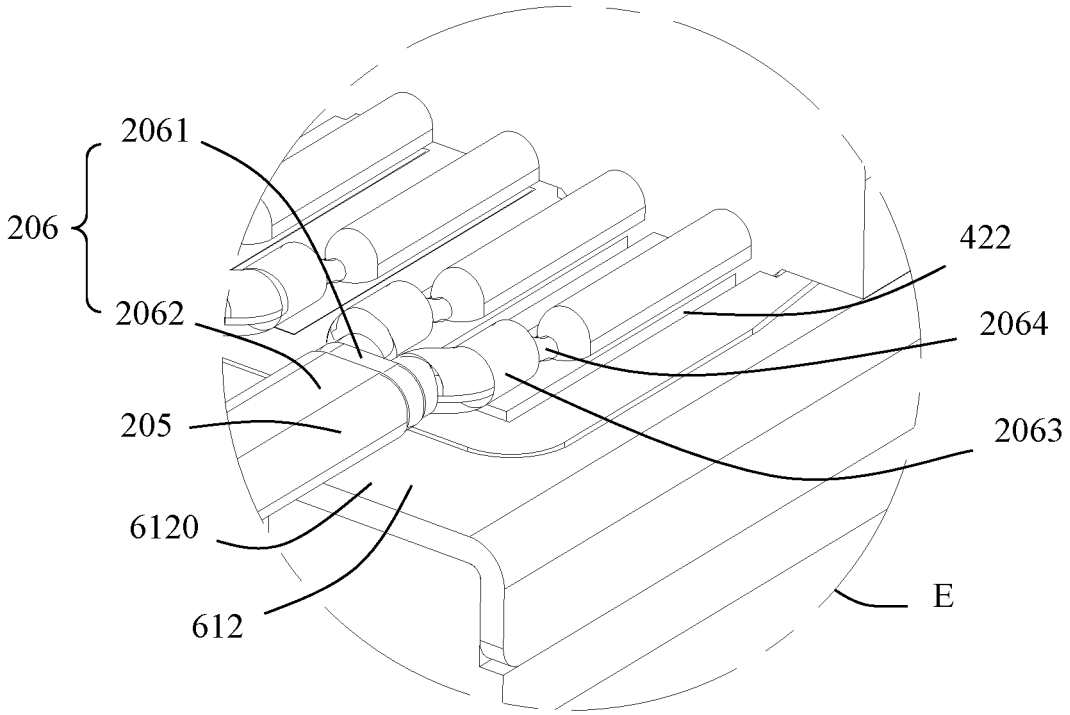
FIG. 37 is a partial enlarged view of a circled portion E in FIG. 27.

The cable 200 includes a plurality of shielding layers 206. In the illustrated embodiment of the present disclosure, each shielding layer 206 is located on an outer layer of the cable 200. The conductive wire clamp 73 includes a plurality of positioning grooves 731 for supporting the second cable segment 205. The conductive wire clamp 73 is electrically connected to the shielding layers 206 and the shielding piece 6. This arrangement increases the shielding area and improves the shielding effect. Referring to FIG. 37, in the illustrated embodiment of the present disclosure, each shielding layer 206 has two layers, including an inner metal shielding layer 2061 and an outer metal shielding layer 2062. In an embodiment, the material of the inner metal shielding layer 2061 is aluminum. The material of the outer metal shielding layer 2062 is copper or other soft shielding materials. The inner metal shielding layer 2061 made of aluminum can achieve a better shielding effect. The cable 200 also includes a core wire 2064 for soldering with the first tail portion 422 of the first conductive terminal 42 or the second tail portion 522 of the second conductive terminal 52, and insulating layer 2063 wrapped on the core wire 2064. The shielding layer 206 is wrapped on the insulating layer 2063. The cable 200 further includes an outer insulation 208 covering a part of the shielding layer 206.

Figure 38:
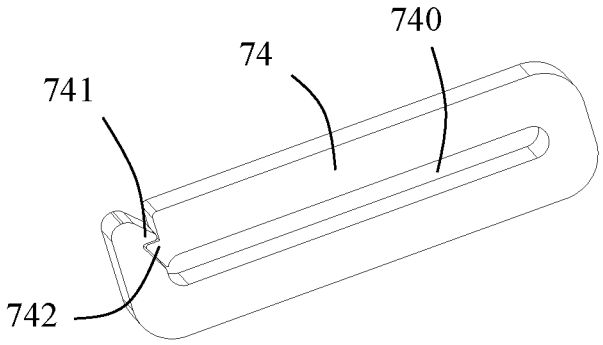
FIG. 38 is a perspective schematic view of a conductive element in FIG. 27.

The conductive element 74 is installed on the first cable segment 204 and is electrically connected with the shielding layers 206 corresponding to the first cable segment 204. Referring to FIG. 37, the transverse wall 6120 of the frame 612 is electrically connected with the shielding layers 206 corresponding to the second cable segment 205. In an embodiment of the present disclosure, the conductive element 74 has a frame-shaped configuration and has a mounting slot 740. The cable 200 passes through the mounting slot 740 of the conductive element 74. Referring to FIG. 38, the conductive element 74 is a ring formed by buckling, which improves the convenience to install it on the cable 200. The conductive element 74 includes a first fixing structure 741 and a second fixing structure 742. The first fixing structure 741 and the second fixing structure 742 can be buckled with each other in the height direction of the conductive element 74. In the illustrated embodiment of the present disclosure, the first fixing structure 741 is a hook. The second fixing structure 742 is a locking protrusion. The material of the conductive element 74 is at least one of a conductive metal (i.e., a conductive silver, a conductive copper, a conductive iron, a conductive steel), a conductive plastic, a conductive graphene, a conductive cloth, a conductive glue, and a conductive foam. The conductive element 74 has a certain deformability. The crimping portion 7134 of the second shielding shell 71 presses against the conductive element 74. In an embodiment of the present disclosure, the crimping portion 7134 of the second shielding shell 71 presses against the conductive element 74 by means of riveting. During riveting, the slot 7133 can provide a better deformation space for the crimping portion 7134, so as to easily and reliably press the crimping portion 7134 against the conductive element 74, and avoid damage to other structures of the second shielding shell 71. After the riveting is completed, the second shielding shell 71, the conductive element 74 and the shielding layers 206 of the cable 200 are tightly connected together, thereby achieving a better shielding protection effect.

Figure 28:
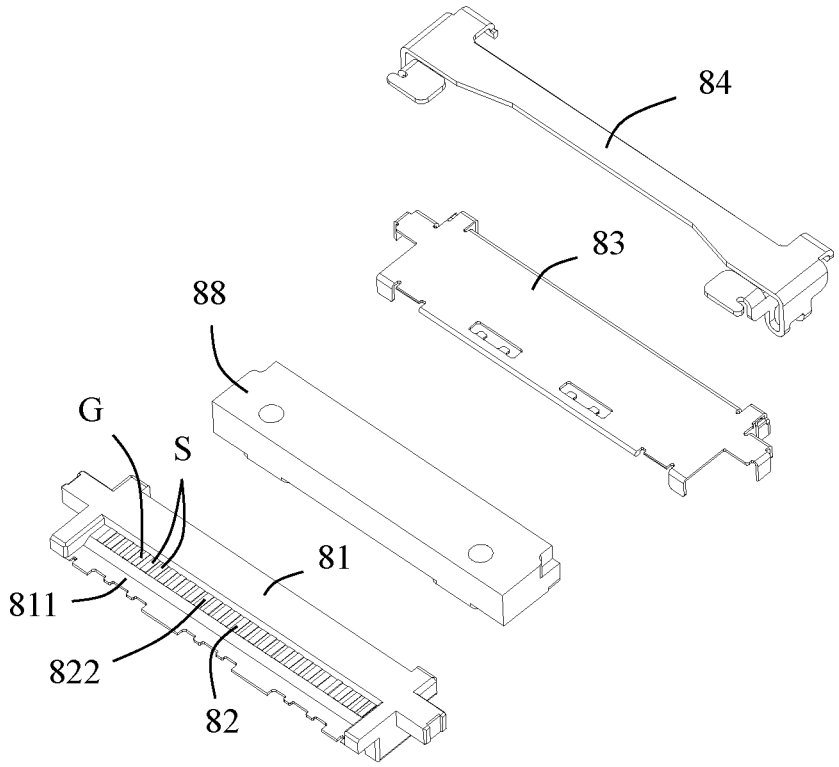
FIG. 28 is a perspective exploded view of a second electrical connector.
Figure 29:
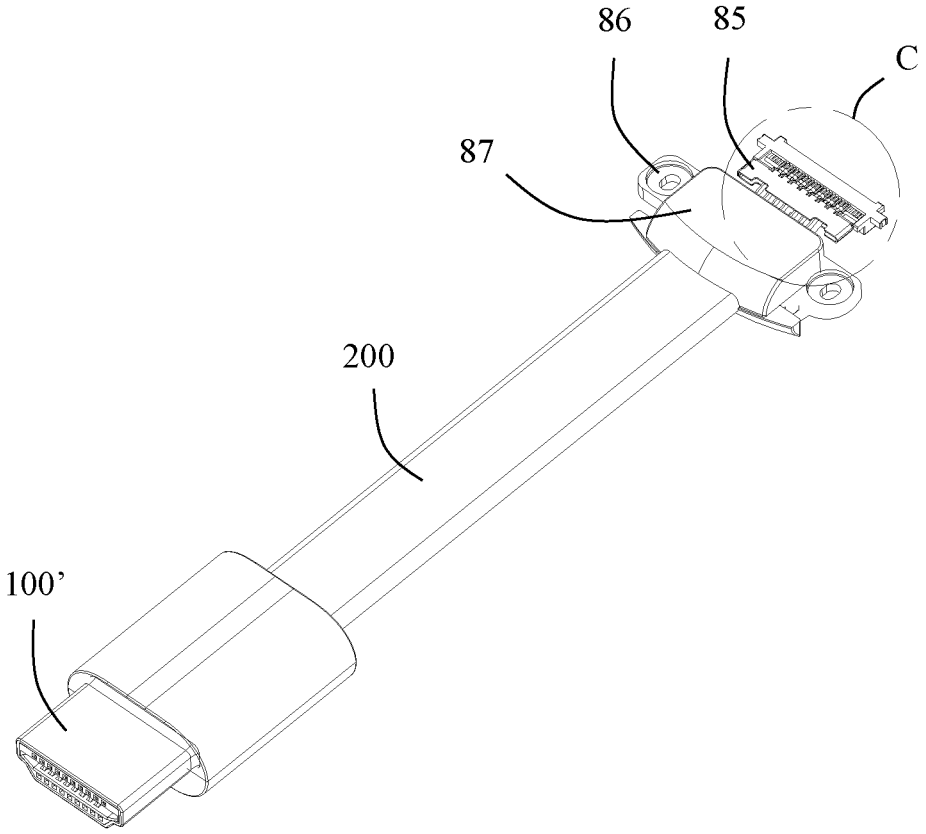
FIG. 29 is a perspective view of the second electrical connector after a first metal shell, a second metal shell and a conductive plastic in FIG. 19 are removed.
Figure 30:
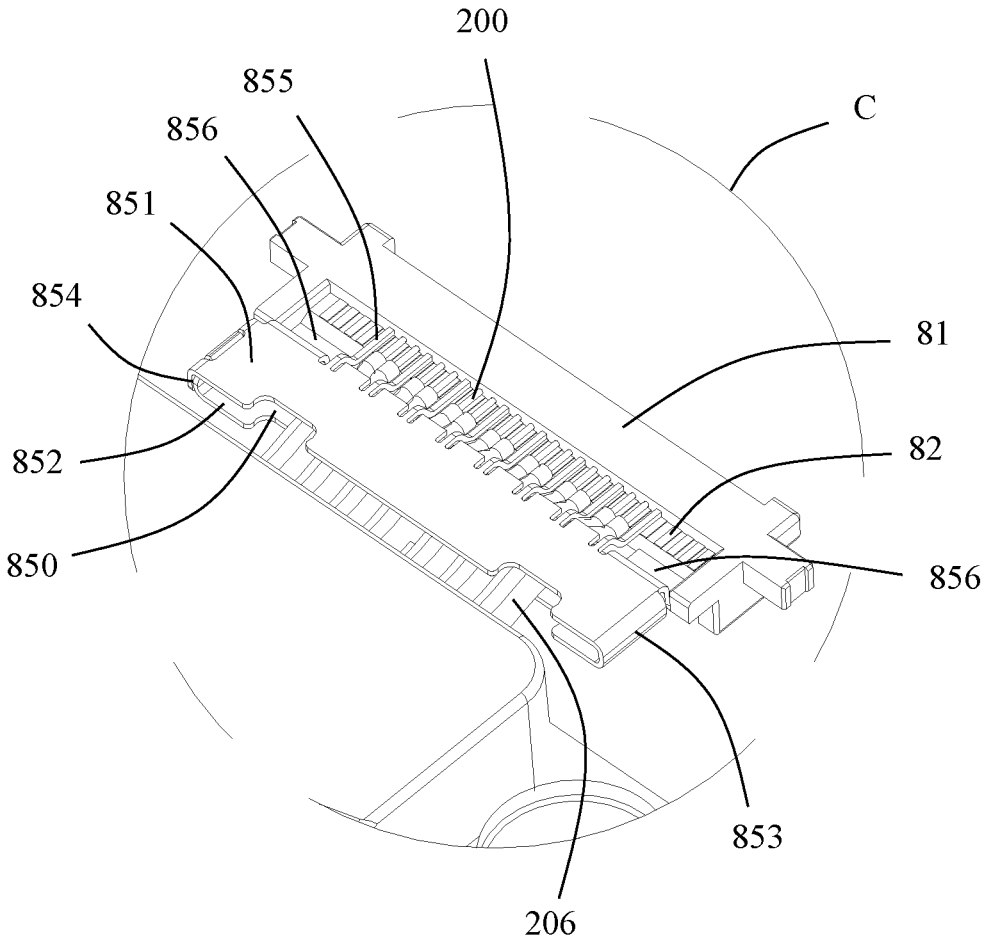
FIG. 30 is a partial enlarged view of a circled portion C in FIG. 29.
Figure 31:
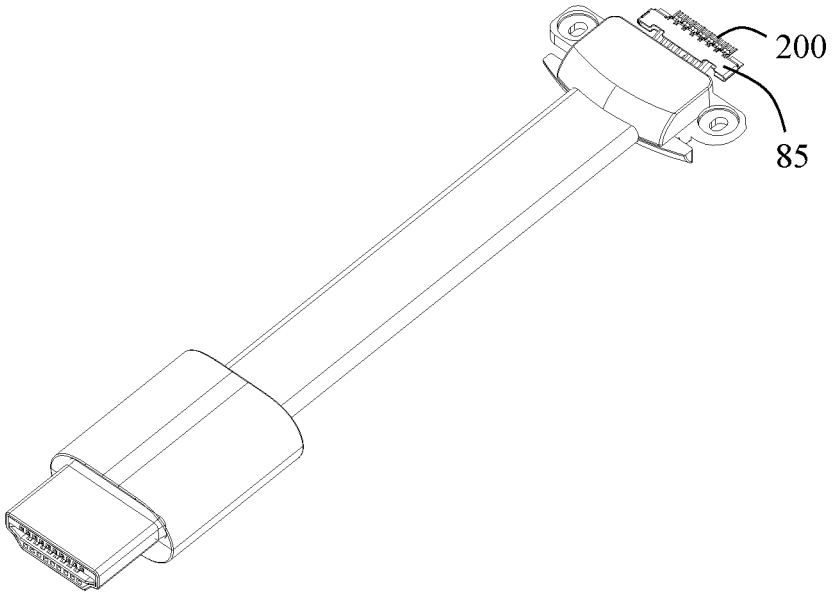
FIG. 31 is a perspective schematic view after removing the second electrical connector and the conductive plastic in FIG. 19.
Figure 32:
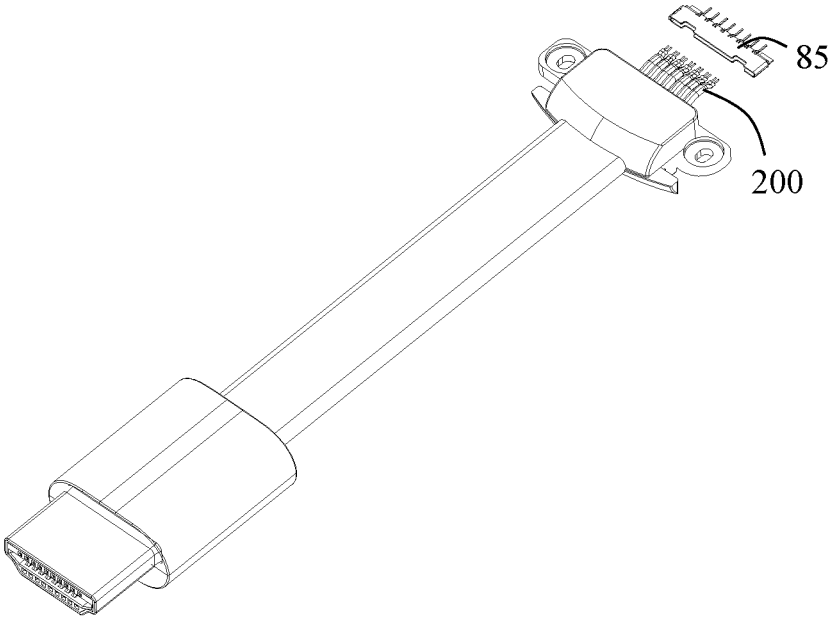
FIG. 32 is a partially exploded perspective view of FIG. 31, in which a grounding element is separated.

Referring to FIG. 28, the second electrical connector 300 includes a second insulating body 81, a plurality of third conductive terminals 82 fixed to the second insulating body 81, a first metal shell 83 covering the second insulating body 81, and a second metal shell 84 shielded on the first metal shell 83. The first metal shell 83 and the second metal shell 84 are electrically connected. In the illustrated embodiment of the present disclosure, the second electrical connector 300 is a Low Voltage Differential Signal (LVDS) connector. Of course, in other embodiments, the second electrical connector 300 may also be another type of electrical connector.

The second insulating body 81 includes an installation platform 811. In an embodiment of the present disclosure, the third conductive terminals 82 are insert-molded with the second insulating body 81. Of course, in other embodiments, the third conductive terminals 82 may also be fixed to the second insulating body 81 by assembling.

Each third conductive terminal 82 includes a third contact portion (not shown) for mating with a mating element (such as a flat cable) and a third tail portion 822 having a flat-plate shape. The third tail portions 822 are exposed on the mounting platform 811 so as to facilitate connection with the cable 200. From a functional point of view, the third conductive terminals 82 include a plurality of signal terminals S and a plurality of ground terminals G.

Referring to FIGS. 29 to 33, the cable connector 400 further includes a grounding element 85 connected to the other end of the cable 200, in an embodiment of the present disclosure, the grounding element 85 is made of a metal material. The grounding element 85 has a frame-shaped configuration and has a mounting slot 850. The cable 200 passes through the mounting slot 850 of the grounding element 85. The grounding element 85 includes a first wall portion 851, a second wall portion 852 opposite to the first wall portion 851, and a connecting wall portion 853 connecting the first wall portion 851 and the second wall portion 852. Both the first wall portion 851 and the second wall portion 852 are electrically connected with the shielding layers 206 of the cable 200. In the illustrated embodiment of the present disclosure, the first wall portion 851 includes a first extending portion 8511 extending toward the second wall portion 852. The second wall portion 852 includes a second extending portion 8521 extending toward the first wall portion 851. The first extending portion 8511 and the second extending portion 8521 are closed so as to form another wall portion 854 opposite to the connecting wall portion 853.

Figure 33:
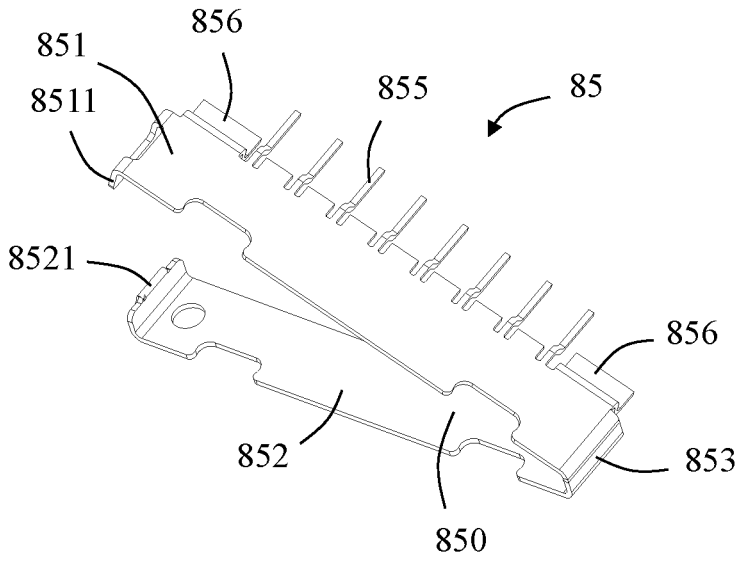
FIG. 33 is a perspective schematic view of the grounding element before being installed on the cables and before being closed.

Referring to FIG. 33, in the illustrated embodiment of the present disclosure, when the grounding element 85 is not installed on the cable 200, one side of the grounding element 85 is open. This design is beneficial for more flexible installation of the grounding element 85 on the cable 200. After the grounding element 85 is installed on the cable 200, the first extending portion 8511 and the second extending portion 8521 may be close to each other so as to form a closed loop. At the same time, the first wall portion 851 and the second wall portion 852 are in close contact with the shielding layers 206. Of course, in other embodiments, the grounding element 85 may also be in a ring shape before being installed on the cable 200. After the grounding element 85 is sleeved on the cable 200, by pressing the first wall portion 851 and the second wall portion 852, the first wall portion 851 and the second wall portion 852 can also be realized 852 to be in close contact with the shielding layers 206. It can be understood that when the grounding element 85 is designed to have a ring structure before being installed on the cable 200, it has stricter requirements for the installation sequence of the grounding element 85.

In another embodiment of the present disclosure, after the grounding element 85 is sleeved on the cable 200, the grounding element 85 is fixed by a conductive plastic member 88 (referring to FIG. 28). In this way, damage to the cable 200 can be avoided in the process of applying force to the grounding element 85.

Specifically, in the illustrated embodiment of the present disclosure, the grounding element 85 further includes a plurality of ground pins 855 extending from the first wall portion 851 and a plurality of contacting protrusions 856 located on opposite sides of the ground pins 855. The ground pins 855 are connected to the ground terminals G of the third conductive terminals 82 (i.e., fixed by soldering). The contacting protrusions 856 are supported on the mounting platform 811 and electrically connected with the first metal shell 83.

Figure 34:
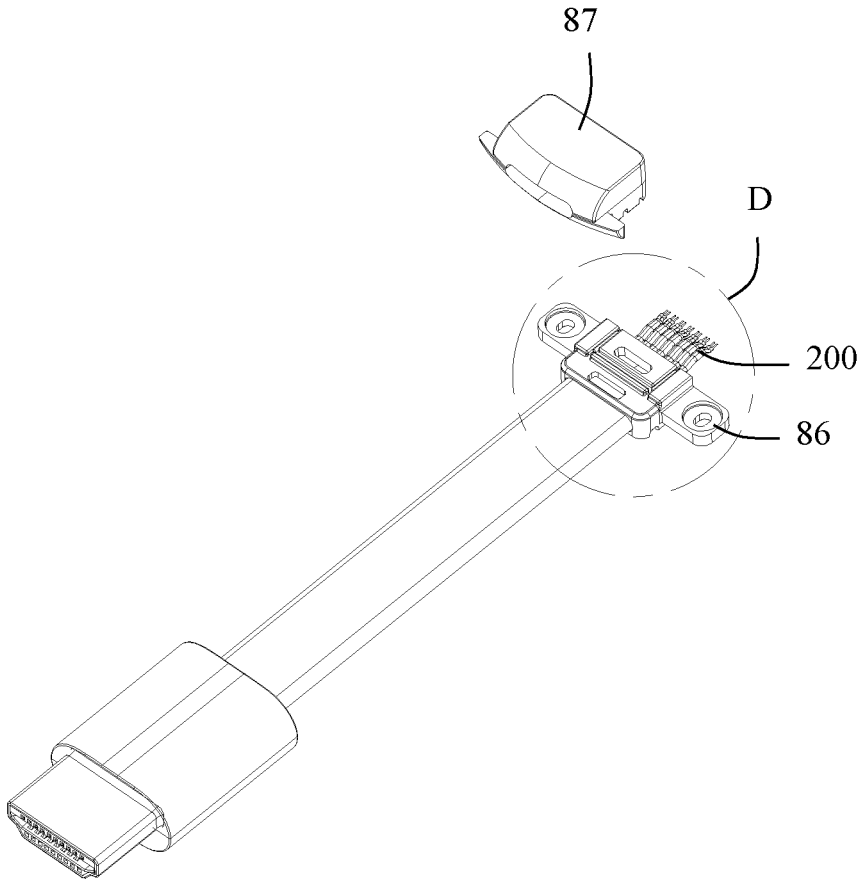
FIG. 34 is a partially exploded perspective view of the grounding element in FIG. 32 after the grounding element is removed, in which the covering housing is separated.
Figure 35:
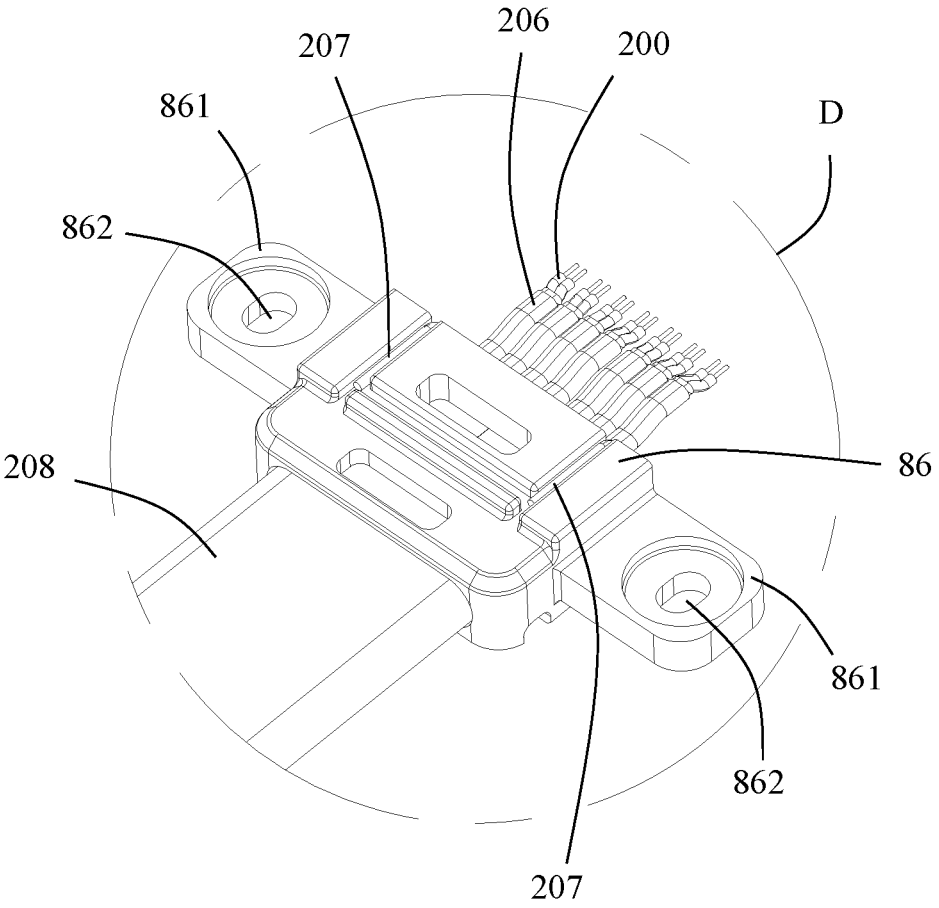
FIG. 35 is a partial enlarged view of a circled portion D in FIG. 34.
Figure 36:
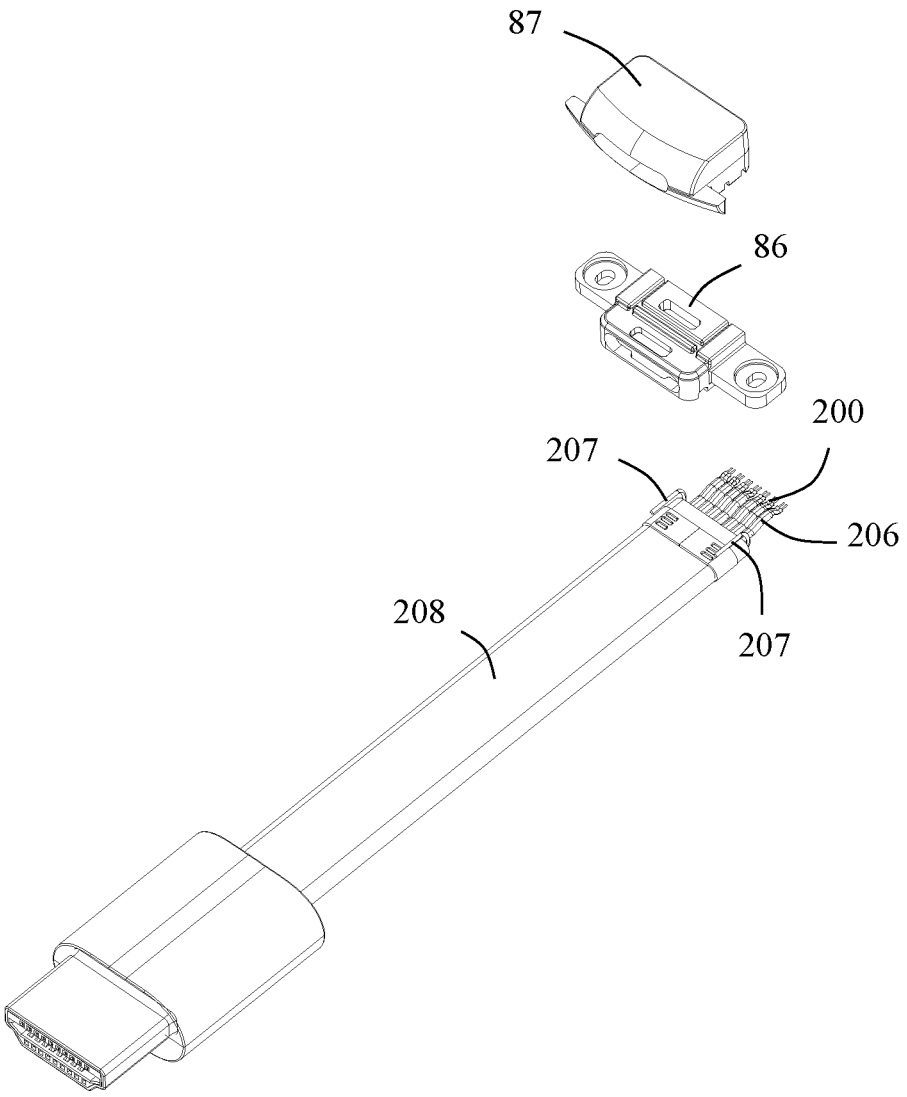
FIG. 36 is a further perspective exploded view of FIG. 34.

Referring to FIGS. 34 to 36, the cable connector 400 further includes a mounting body 86 fixed on the cable 200 and spaced apart from the grounding element 85, and a covering housing 87 fixed on the mounting body 86. In an embodiment of the present disclosure, the covering housing 87 is over-molded on the mounting body 86. The mounting body 86 includes a pair of mounting portions 861 protruding oppositely and sidewardly beyond the cable 200. Each mounting portion 861 includes a mounting hole 862. The cable 200 includes a plurality of ballistic threads 207 folded and mounted on the mounting body 86. The covering housing 87 fixes the ballistic thread 207. This arrangement is beneficial to increase the tensile strength of the cable 200.

After the second electrical connector 300, the cable 200, the grounding element 85, etc., are installed in place, the contact between the grounding element 85 and the shielding layers 206 of the cable 200 forms a first guarantee of shielding. The first wall portion 851 partially extends into the second electrical connector 300, and the contact between the grounding element 85 and the first metal shell 83 forms a second guarantee of shielding. The first metal shell 83, the grounding element 85, the third conductive terminal 82 and the cable 200 are fixed together by the conductive plastic member 88, thereby forming a third guarantee of shielding. With this arrangement, the cable connector 400 has a better shielding function at the position of the second electrical connector 300, and the quality of data transmission is improved.

In order to better understand the present disclosure, an upper concept of the conductive element 74 and the grounding element 85 is a ground shield; and an upper concept of the first shielding shell 3, the second shielding shell 71, the first metal shell 83 and the second metal shell 84 is a shielding shell.

The above embodiments are only used to illustrate the present disclosure and not to limit the technical solutions described in the present disclosure. The understanding of this specification should be based on those skilled in the art. Descriptions of directions, such as "front", "back", "left", "right", "top" and "bottom", although they have been described in detail in the above-mentioned embodiments of the present disclosure, those skilled in the art should understand that modifications or equivalent substitutions can still be made to the application, and all technical solutions and improvements that do not depart from the spirit and scope of the application should be covered by the claims of the application.

What is claimed is:

1. A cable connector, comprising:

a plurality of cables, each cable comprising a core wire, an insulating layer wrapped on the core wire and a shielding layer wrapped on the insulating layer;

an electrical connector, the electrical connector comprising an insulating body, a plurality of conductive terminals and a shielding shell, each conductive terminal comprising a contact portion for mating with a mating connector and a tail portion connected with the core wire; and a ground shield, the ground shield being mounted to the cables, the ground shield being connected with the shielding layers of the cables, and the ground shield being connected with the shielding shell;

wherein the electrical connector comprises a second electrical connector, the insulating body comprises a second insulating body, the conductive terminals comprise a plurality of third conductive terminals, the shielding shell comprises a first metal shell covering the second insulating body, the contact portion comprises a third contact portion formed on each third conductive terminal, the tail portion comprises a third tail portion formed on each third conductive terminal, and the ground shield comprises a grounding element which is electrically connected with the first metal shell;

wherein the grounding element comprises a first wall portion electrically connected with the shielding layers of the cables; and wherein the third tail portion has a flat-plate shape, the third conductive terminals comprise a plurality of ground terminals, the grounding element comprises a plurality of ground pins extending from the first wall portion, and the ground pins are connected with the ground terminals.

2. The cable connector according to claim 1, wherein the grounding element comprises a second wall portion opposite to the first wall portion; and wherein the first wall portion and the second wall portion are electrically connected with the shielding layers of the cables.

3. The cable connector according to claim 2, wherein the grounding element comprises a connecting wall portion connecting the first wall portion and the second wall portion, the first wall portion comprises a first extending portion extending toward the second wall portion, the second wall portion comprises a second extending portion extending toward the first wall portion, the first extending portion and the second extending portion are closed so as to form another wall portion opposite to the connecting wall portion.

4. The cable connector according to claim 1, wherein the second insulating body comprises a mounting platform, the third tail portions are exposed on the mounting platform, the first wall portion partially extends into the second electrical connector, the first wall portion comprises contacting protrusions located on both sides of the ground pins, the contacting protrusions are supported on the mounting platform, and the contacting protrusions are electrically connected with the first metal shell.

5. The cable connector according to claim 1, further comprising a mounting body fixed on the cables and spaced apart from the grounding element, wherein the cables comprise a plurality of ballistic threads which are folded and mounted on the mounting body.

6. The cable connector according to claim 5, wherein the mounting body comprises a pair of mounting portions protruding oppositely and sidewardly beyond the cables, and each mounting portion defines a mounting hole.

7. The cable connector according to claim 5, further comprising a covering housing fixed on the mounting body, and the covering housing fixes the ballistic threads.

8. The cable connector according to claim 1, further comprising an outer insulation wrapped on the shielding layers of the cables.

9. A cable connector, comprising:

a plurality of cables, each cable comprising a core wire, an insulating layer wrapped on the core wire and a shielding layer wrapped on the insulating layer;

an electrical connector, the electrical connector comprising an insulating body, a plurality of conductive terminals and a shielding shell, each conductive terminal comprising a contact portion for mating with a mating connector and a tail portion connected with the core wire; and a ground shield, the ground shield being mounted to the cables, the ground shield being connected with the shielding layers of the cables, and the ground shield being connected with the shielding shell;

wherein the electrical connector comprises a second electrical connector, the insulating body comprises a second insulating body, the conductive terminals comprise a plurality of third conductive terminals, the shielding shell comprises a first metal shell covering the second insulating body, the contact portion comprises a third contact portion formed on each third conductive terminal, the tail portion comprises a third tail portion formed on each third conductive terminal, and the ground shield comprises a grounding element which is electrically connected with the first metal shell; and wherein the electrical connector comprises a conductive plastic member fixing the first metal shell, the grounding element, the third conductive terminals and the cables together.

10. A cable connector, comprising:

a plurality of cables, each cable comprising a core wire, an insulating layer wrapped on the core wire and a shielding layer wrapped on the insulating layer;

an electrical connector, the electrical connector comprising an insulating body, a plurality of conductive terminals and a shielding shell, each conductive terminal comprising a contact portion and a tail portion, the tail portion being connected with corresponding core wire; and a ground shield, the ground shield being of a frame-shape configuration and defines a mounting slot through which the cables extend, and the ground shield being in contact with the shielding layers of the cables and being in contact with the shielding shell;

wherein the ground shield comprises a first side wall, a second side wall opposite to the first side wall, a third side wall connecting one side of the side wall and one side of the second side wall, and a fourth side wall opposite to the side wall; the mounting slot is jointly enclosed by the first side wall, the second side wall, the third side wall and the fourth side wall; and wherein the ground shield is configured to be opened in a manner that the first side wall and the second side wall are away from each other, so as to facilitate assembling the ground shield to the plurality of cables; and wherein the ground shield is configured to be closed in a manner that the first side wall and the second side wall are located closed to each other, so as to clip the plurality of cables.

11. The cable connector according to claim 10, wherein the electrical connector comprises a first electrical connector, the insulating body comprises a first insulating body, the conductive terminals comprise a plurality of first conductive terminals and a plurality of second conductive terminals, the shielding shell comprises a first shielding shell enclosing the first insulating body and a second shielding shell connected to the first shielding shell, the contact portions comprise a first contact portion formed on each first conductive terminal and a second contact portion formed on each second conductive terminal, the tail portion comprises a first tail portion formed on each first conductive terminal and a second tail portion formed on each second conductive terminal, and the ground shield comprises a conductive element which is in contact with the second shielding shell.

12. The cable connector according to claim 11, wherein material of the conductive element is at least one of a conductive metal, a conductive plastic, a conductive graphene, a conductive cloth, a conductive glue, and a conductive foam.

13. The cable connector according to claim 10, wherein the electrical connector comprises a second electrical connector, the insulating body comprises a second insulating body, the conductive terminals comprise a plurality of third conductive terminals, the shielding shell comprises a first metal shell covering the second insulating body, the contact portion comprises a third contact portion formed on each third conductive terminal, the tail portion comprises a third tail portion formed on each third conductive terminal, and the ground shield comprises a grounding element which is in contact with the first metal shell.

14. The cable connector according to claim 13, wherein the grounding element comprises a first wall portion and a second wall portion opposite to the first wall portion; wherein the first wall portion and the second wall portion are in contact with the shielding layers of the cables.

15. The cable connector according to claim 14, wherein the third tail portion has a flat-plate shape, the third conductive terminals comprise a plurality of ground terminals, the grounding element comprises a plurality of ground pins extending from the first wall portion, and the ground pins are connected with the ground terminals.

16. The cable connector according to claim 15, wherein the second insulating body comprises a mounting platform, the third tail portions are exposed on the mounting platform, the first wall portion partially extends into the second electrical connector, the first wall portion comprises contacting protrusions located on both sides of the ground pins, the contacting protrusions are supported on the mounting platform, and the contacting protrusions are in contact with the first metal shell.

17. The cable connector according to claim 10, wherein the first side wall comprises a first fixing structure, the second side wall comprises a second fixing structure, and the first fixing structure and the second fixing structure are locked with each other when the ground shield is closed.

18. The cable connector according to claim 10, wherein the fourth side wall comprises a first wall bent from the first side wall and a second wall bent from the second side wall, the first wall defines a slit, and the second wall comprises a protruding tab received in the slit.

* * * * *